US006342844B1

(12) United States Patent
Rozin

(10) Patent No.: US 6,342,844 B1
(45) Date of Patent: Jan. 29, 2002

(54) TWO-WAY RADIO-BASED ELECTRONIC TOLL COLLECTION METHOD AND SYSTEM FOR HIGHWAY

(76) Inventor: Alexander Rozin, P.O. Box 11043, Jerusalem 91110 (IL)

( * ) Notice: Subject to any disclaimer, the term of this patent is extended or adjusted under 35 U.S.C. 154(b) by 0 days.

(21) Appl. No.: 09/174,801

(22) Filed: Oct. 15, 1998

(30) Foreign Application Priority Data

Nov. 4, 1997 (IL) ..... 122105

(51) Int. Cl.[7] ..... G08G 1/00

(52) U.S. Cl. ..... 340/933; 340/928; 342/42; 701/117

(58) Field of Search ..... 340/928, 933, 340/901, 905; 342/42; 701/117

(56) References Cited

U.S. PATENT DOCUMENTS

| | | | | | |
|---|---|---|---|---|---|
| 4,123,754 | A | * | 10/1978 | Armstrong | 342/44 |
| 5,552,789 | A | * | 9/1996 | Schuermann | 342/42 |
| 5,602,919 | A | * | 2/1997 | Hurta et al. | 380/24 |
| 6,181,259 | B1 | * | 1/2001 | Yamashita | 340/901 |
| 6,191,705 | B1 | * | 2/2001 | Oomen et al. | 340/905 |

* cited by examiner

*Primary Examiner*—Edward Lefkowitz

(57) ABSTRACT

This invention relates generally to automatic radio-frequency (RF) real-time high-way toll collection from moving vehicles. It especially adapted to the use of an untraceable electronic check debited from smart card and communicated in a cryptographically sealed envelope message. The invention relates directly to an in-vehicle unit (IVN), noncontact IC card (NIC), and a roadside collection station (RCS) and to an overall system incorporating a plurality of RCS's, IVN's and NIC's. The invention may be used for parking collections and other types of road pricing and individual access remote control applications, that require personal authentication and payment. The new in the art is two-way radio-based electronic toll collection method on highway comprising the steps of providing communication terminal (Reader/Writer) with RF antenna which transmits continuously downlink energy-transmitting signal at first predetermined frequency, and generates a communication hopping channels for bi-directional data transfer, moreover hopping frequency is synthesized of said first predetermined frequency used as reference. Next phase of said toll collection method is to furnish each vehicle passing along the highway with a noncontact IC card capable to receive downlinked energy-transmitting signal in order to power the electronic components integrated within IC card, to synthesize of a communication channels of hopping frequency, that are synchronized by the said first radio-frequency used as reference.

17 Claims, 10 Drawing Sheets

Author: Alexander Rozin

Two-way radio-based electronic toll collection system

Author: Alexander Rozin

A two-way radio-based electronic toll collection system

Author: Alexander Rozin

A two-way radio-based electronic toll collection system

TWO-WAY RADIO-BASED ELECTRONIC TOLL COLLECTION METHOD AND SYSTEM FOR HIGHWAY

FIELD OF THE INVENTION

This invention relates generally to automatic radio-frequency (RF) real-time high-way toll collection from moving vehicles. It especially adapted to the use of an untraceable electronic check debited from smart card and communicated in a cryptographically sealed envelope message. The invention relates directly to an in-vehicle unit (IVN), noncontact IC card (NIC), a roadside collection station (RCS) and to an overall system incorporating a plurality of RCS's, IVN's and NIC's. The invention may be used for parking collections and other types of road pricing applications.

In addition this invention may be used for individual access control wherein the remote toll systems enable personal authentication and payment.

BACKGROUND OF THE INVENTION

An automatic toll-paying systems which utilizes a recording medium, for example an integrated circuit card (IC card), of a prepaid system has been previously developed for paying charges for utilization of pay facilities, for example for paying a toll for passage over a toll road or for a passage over a toll-gate in public transport. In such a prepaid systems, a prepaid amount of money is recorded beforehand on a recording medium, and every time a toll road is utilized, a toll for passage is subtracted from the amount of money recorded on a recording medium through wireless communication at a tollbooth gate at an entrance or an exit, and a balance is recorded on the recording medium.

However, in the case of such an automatic toll-paying systems, if a balance recorded on the recording medium is not enough for a necessary amount of money such as a toll for passage it becomes difficult to pay using the recording medium and complicated operations becomes necessary such as a shortage amount must be paid in cash, or this debt has to be stored in the recording medium or in a special accumulator in a vehicle carried device and afterward the debt should be returned to the creditor.

In order to solve the mentioned problems there is a few decisions presently utilized in similar operation comprising communication via electromagnetic waves.

The first group of an automatic toll-paying systems includes a microwave and cryptographic units arranged on-board of a vehicles. This unit comprising reader/writer block to operate with contact computerized and/or memorized prepaid smart cards. U.S. Patents which reflect the discussing area are hereby incorporated herein by reference:

U.S. Pat. No. 5,485,520—Chaum et. al. (1996);
U.S. Pat. No. 5,663,548;—Hayashi et. al. (1997)
U.S. Pat. No. 5,532,689—Bueno et. al. (1996)
U.S. Pat. No. 5,608,417;—de Vall et. al. (1997)
U.S. Pat. No. 5,661,286—Shuno et. al. (1997)

One or more roadside collection stations (RCS) communicate over a short-range, high speed bi-directional microwave communication link with one or more in-vehicle units (IVU) associated with one or more respectively corresponding vehicles in one or more traffic lanes of a highway (U.S. Pat. No. 5,485,520). At least two up-link (IVU to RCS) communication sessions and at least one downlink (RCS to IVU) communication session are transacted in real time during the limited duration of an RCS communication footprint as the vehicle travels along its lane past a highway toll plaza. Especially efficient data formatting and processing is utilized so as to permit, during this brief interval, computation of the requisite toll amount and a fully verified and cryptographically secured (preferably anonymous) debiting of a smart card containing electronic money. Preferably an untraceable electronic check is communicated in a cryptographically sealed envelope with opener. Transaction linkage data is utilized in each phase of the complete toll payment transaction to facilitate simultaneous multi-lane RCS/IVU operation. A plaza computer local area network and downlink plaza controller is also used to facilitate simultaneous multi-lane transactions.

A hand-held portable smart-card reader/writer with radio frequency receiving/transmitting means is disclosed in U.S. Pat. No. 5,532,689 France. Herein is described a method of transmitting data quickly and securely from a smart card during a remote transaction between a fixed station and a mobile item of equipment containing a smart-card reader, said card reader having a fast memory, wherein, on receiving said card, and in addition to storing the data from the card in said fast memory, said reader also stores a pair of data items in said fast memory, one of which data items identifies the number of the card, and the other data item corresponds to an access count indicating the number of accesses to the card, each access by any reader incrementing the access count in the card by unity, and wherein, during the transaction, the mobile item of equipment, which is interrogated remotely by the fixed station, compares said pair of data items stored in said fast memory of said reader with the pair of data items of the card that is currently inserted in the mobile item of equipment, and transmits the result of the comparison and the data of the card, which data is stored in the fast memory, to the fixed station.

However a vehicle carried units for automatic toll payment systems are too complicated device as they operate in a microwave mode similar to cellular telephones and pagers. Furthermore the hand-held and/or vehicle carried unit must have IC card reader/writer with appropriate security functions to prevent tampering and/or using of forged (false) IC cards. All these features add an additional value in the cost of a system, and do not make it versatile and convenience to spread these system to the other market applications. Moreover the vehicle carried units can not be used in individual transport applications like in subway gates or in buses due to it cost, complexity and non convenient to use and wherein person uses individual contactless radio frequency IC cards becoming to be versatile.

The radio frequency (RF) Smart cards become to be a standard convenience element for transport and access applications. These noncontact IC cards and/or tags for performing proximate data communication between IC card and the terminal by using electromagnetic waves and having at least one inductive coil employees antenna for power transfer and data interchange are illustrated in U.S. Patents reflecting these area are hereby incorporated herein by reference:

U.S. Pat. No. 5,444,222—Inoue et. al., 1995;
U.S. Pat. No. 5,394,105—Axer et. al., 1995;
U.S. Pat. No. 5,440,302—Irmer et. al., 1995;
U.S. Pat. No. 5,329,274—Donig et. al., 1994;
U.S. Pat. No. 5,418,358—Bruhnke et. al., 1995;
U.S. Pat. No. 5,449,894—Bruhnke et. al., 1995;
U.S. Pat. No. 5,418,353—Toride et. al., 1995;
U.S. Pat. No. 5,426,667—van Zon et. al., 1995;
U.S. Pat. No. 5,241,298—Lian et. al., 1993;
U.S. Pat. No. 5,317,330—Everet et. al. 1994;

U.S. Pat. No. 5,065,137—Herman et. al. 1991.

Systems for noncontact exchange of data are known in different designs and types. Inductively operating systems comprising radio frequency tags and reader/writer terminal and performing low frequency range less than one megahertz (MHz) that allows to operate at relatively long distances are well known in the art. Such tags provide the advantage of permitting through-the-body operation and easy clock generation. However these low frequency systems can not provide relatively high rate data exchange, an despite that they may operate at relatively long distances the portable carrier must be attendant in a special recognition area during a significant time to provide identification and data transfer. Furthermore these systems can not provide the adequate protection on security level during short interaction time because of low rate of data exchange. Moreover they operate at constant frequency that allow the interception of a signal and hacking of security. In addition the returning signal from tag to the reader is more than 80 dB less than transmitted signal from the reader to the tag.

The embodiment disclosed in U.S. Pat. No. 5,317,330 enables to increase power retransmitted from portable carrier-tag to the reader by means of providing dual resonant antenna which performs parallel resonant at the receive frequency and series resonant at the transmit frequency. The parallel resonant circuit of antenna derives operating power from the signal transmitted by the stationary member. The series resonant circuit transmits the coded information at a second frequency which differs from the first frequency. Two embodiments are disclosed: first where tag transmission is provided with less frequency: divided by two, and second where tag transmission is provided with higher frequency: multiplied by two. However the method of frequency multiplication is not disclosed. Herein the operation is provided at two constant frequencies that allow the interception of a signal and hacking of secure information. The simultaneous operation in the same capture area of a few alike devices is accompanied with signal interference and collisions.

The embodiment disclosed in U.S. Pat. No. 5,608,417 comprising a transponder system employs a transponder antenna with a distributed inductance and capacitance that exhibit parallel and series resonant frequencies. Transmissions to the transponder circuit are made at one or more parallel resonant frequencies to maximize the excitation of the transponder circuit, while return signals transmitted back from the transponder are modulated at one or more series resonant frequencies to maximize the signal current. The transponder antenna is implemented as a pair of aligned coils on opposite sides of a thin dielectric substrate, with the coils connected together through the substrate at one point and the substrate thickness not more than about 25 microns to obtain a significant mutual inductance between the coils. The transponder circuit is designed to respond to the fundamental parallel resonant frequency, at which the maximum voltage is generated by transponder winding, but to transmit the information signal back at a series resonant frequency at which the current in the transponder winding is maximized thus maximizing the strength of the returning signal. The transponder winding has both multiple parallel resonant frequencies and multiple series resonant frequencies. Different parallel resonant frequencies may be used for energizing the transponder at the fundamental and writing to the transponder at the harmonic. Similarly different types of information may be returned from the transponder at a different series resonant frequencies.

However the embodiment of U.S. Pat. No. 5,608,417 suffers of many mutual couplings because of distributed inductive and capacitive parameters, which activate many sub-resonant effects, signal scatters and distorts and therefore electronic circuit for proper signal detection and modulation becomes to be too complicated and expensive. Furthermore this embodiment may operate exclusively with frequencies derived as multiplying from fundamental frequency of parallel resonance. Consequently the simultaneous operation of a more than one transponder with one reader/writer will bring into communication collisions. The data transmission is provided by continuous wave with constant frequency. Security features of transmitted data may be achieved solely with software design and one may intercept and decipher data interchange. In addition the utilization of described embodiment in high-speed access and transit systems, like toll high-way systems and toll gates, is difficult because of collisions occurring while IC cards are using the same frequency assortment at once. Moreover the automatic toll-paying systems utilize special roadside collection stations mounted on a special towers remote from moving vehicles, therefore the demand arises to enlarge the amplitude of electromagnetic energy transmitted to the transponder in order to provide power of on-card electronic circuit and proper operation on harmonics. And it is known that each harmonic has an amplitude less then dominant in a few times in proportion to a harmonic number. Still the radiation power limits are restricted by international standards like FCC (USA) and EITS (Europe) and thus it is impossible to power similar RF IC card over large distance more than a few feet.

The mentioned above systems do not possess a battery of its own and which draw supply energy required for the functioning of the active electronic components of the responder circuit from the electromagnetic interrogation field, by means of which digital information stored in the responder may be detected. Furthermore, the mentioned above systems may provide the possibility of contactless modification of a data stored in the memory of a responder.

The non-contact IC cards used in such a systems are considered to be conventional according to dimensions and size, and, in general, a noncontact card has the shape of a portable member and a size generally equal to that of ordinary magnetic cards, and has internal coil antenna formed as a spiral copper foil pattern by etching or the like.

The operation of the RF noncontact IC card when a person who possesses the IC card passes, for example, through a special toll gate controlled by terminal, looks like electromagnetic wave serial exchange between the IC card and terminal over selected allowed channel of a communication link. However there are a very narrow windows in permitted radio-band on electromagnetic radiated fields, which are possible to use to power radio-frequency cards. Particularly at frequencies below 13.56 MHz, it is possible, by limiting the distance between the terminal (R/W) and the card (transponder) to derive the energy for the contactless smart card from the radio waves. Notwithstanding the frequency spectrum for a given radio systems is a limited communication resource (band width and consequently the data rate) and several users may be competing for this communication resource, that may guide to the collisions and interference, and of this kind systems can not provide reliable operation when more than one noncontact IC card is located in active area of a terminal.

One of the nearest to our invention embodiment is disclosed in U.S. Pat. No. 5,426,667 where the System for the contactless exchange of data between one or more transmitter/receiver devices and a plurality of responders is described. According to the invention, the responder is designed to exchange data via a microwave connection with a transmitter/receiver device operating in the microwave range, and to exchange data via an inductive coupling with an inductively operating transmitter/receiver device.

A system for the contactless exchange of data between at least one transmitter/receiver device and a plurality of responders, wherein at least one of the responders is designed to exchange data via a microwave connection with at least one of said at least one transmitter/receiver device operating in the microwave range and to exchange data via an inductive coupling with at least one inductively operating transmitter/ereceiver device, said at least one responder comprising a microwave antenna device, an inductively operating antenna device, and a data carrier, in which data is stored, wherein between the data carrier and the microwave antenna device means are connected for modulating a received microwave signal with data stored in the data carrier and wherein between the data carrier and the inductively operating antenna device means are connected for modulating an inductively received signal with data stored in the data carrier. However this embodiment operates at one constant frequency (low and/or high) and responders may operate entirely sharing the time to prevent collisions and interference. In addition this system is guarded against signal interception and deciphering on a software level solely and one may record easily the communication protocols and temper it. Moreover the frequency spectrum for a given radio system is a limited communication resource and several users may be competing for this communication resource, that may guide to the collisions and interference, and of this kind systems can not provide reliable operation when more than one noncontact IC card is located in active area of a terminal.

The goal of present invention is to merge the convenience of a conventional noncontact radio frequency cards with advanced performances of a complicated apparatuses, like present modern an in-vehicle units for automatic toll collection, comprising functions of a reading/writing from IC cards and transmitting payment information to a distant road collection station. Herein the operating distance is increased and the simultaneous stable non-collision and non-interference operation of a several cards is provided. Furthermore the hopping communication channels support the preventing of interception and easy decoding and deciphering of radio-frequency signal with an attempt of a tempering.

Another object of the present invention is to shorten the time of passing through the toll gates, because if prepaid balance is not enough to pay, the debt is recorded into the IC card memory and the next card entering into an ATM machine is accompanied with payment of all previous debts. Besides, the eliminating of reader/writer functions from in-vehicle unit prevents a possibility of hacking of in-vehicle unit with a purpose to avoid reader/writer and send a fraud information about money transfer.

Next purpose of a preferred embodiment is the utilization of the single versatile noncontact IC card which may, like present modern IC cards do, to store prepaid value, keep the balance and refund debt automatically while the next operation of money charging into card occurs. The same card may be used in many applications with and without the in-vehicle unit like in automatic vehicle identification, parking, in realtime highway toll collection systems, in public transportation for fare collection, and remote authentication.

Additional destination of a preferred embodiment is to provide a low cost solution of a system, comparable with that of the modern noncontact IC card which is built using the already created inexpensive production technology of internal spiral coil antenna for conventional economical and standard RF Cards. Using the same technology the printing of a conductive strip antenna do not add a significant price.

The other target of a preferred embodiment is to obtain a low cost of in-vehicle unit due to canceling it's additional functions as participation in data transmission, reading/writing from/to the card and balance calculation, and elimination of all gadget displays.

Additional object of the present invention is to obtain the non-contact IC card of a conventional size and, in general, a noncontact card must have the shape of a portable member and a size generally equal to that of ordinary magnetic cards having internal coil antenna formed as a spiral copper foil pattern by etching or the like.

SUMMARY OF THE INVENTION

1. In view of the described above problems and goals, an object of a present invention is to provide a two-way radio-based electronic toll collection method to be implemented on highway comprising the steps of providing communication terminal (Reader/Writer) with RF antenna which transmits continuously downlink energy-transmitting signal of first predetermined frequency, and generates a communication hopping channels for bi-directional data transfer, moreover hopping frequency is synthesized of said first predetermined frequency used as reference. Next phase of said toll collection method is to furnish the each vehicle passing along the highway with a noncontact IC card capable to receive said downlink energy-transmitting signal of first predetermined frequency in order to power the electronic components integrated within IC card, which provide the synthesizing of a communication channels of hopping frequency, synchronized by the said first radio-frequency used as reference, and wherein a noncontact card scrolls, detects and selects the available communication hopping channels to establish bi-directional data transfer. In additional the method comprises the installing of in-vehicle unit in each vehicle passing along the highway to receive the said downlink energy-transmitting signal of first predetermined frequency and to verify the field strength of said energy-transmitting signal in order to enable regeneration by in-vehicle unit of an extra portion of energy-transmitting alternating field at the second predetermined frequency with a purpose to feed a noncontact IC card and provide a regular IC card operation. In this method the exchanging of a toll collection and payment information wirelessly between said communication terminal and said noncontact IC card via said bi-directional communication hopping channels start after the one of the channels of available plurality is selected. Said method permits multiple users to communicate over said bi-directional communication hopping channels preventing collisions, interference, interception and easy deciphering of toll collection and payment information.

Additional object of a present invention is to provide a noncontact IC card, a terminal for use with noncontact IC card and an in-vehicle carried unit which can radiate additional portion of electromagnetic energy over inductive coupling to power noncontact IC card and a noncontact IC card system having a roadside terminal for use with noncontact IC card and an in-vehicle carried unit and noncontact IC card, wherein the road terminal radiates first radio-frequency of an energy-transmitting signal to power said IC card, and wherein first radio-frequency is used by the IC card as a reference clock to synthesize higher band frequencies to provide a sequence of communication channels using channel hopping in order to realize bi-directional data communication, and wherein card antenna circuit provides parallel resonant to derive operating power from the energy-transmitting signal transmitted by the road terminal (stationary member), and wherein card antenna circuit provides series resonant to transmit and receive data, and wherein in-vehicle unit provides supplementary (extra) portion of electromagnetic radiation to power IC card when IC card located distantly from terminal.

Herein in preferred embodiment the parallel resonant circuit antenna presents a high impedance resulting in a large voltage with a small current flow, meanwhile the series resonant circuit antenna presents a low impedance which results in a large current with a small applied voltage. The series resonance minimize the effect of the high frequency transmitted/received signal on the low frequency power signal, enabling simultaneous energy receive and data transmit/receive operation through the same physical antenna circuit.

DESCRIPTION OF THE INVENTION

Figure 1A:
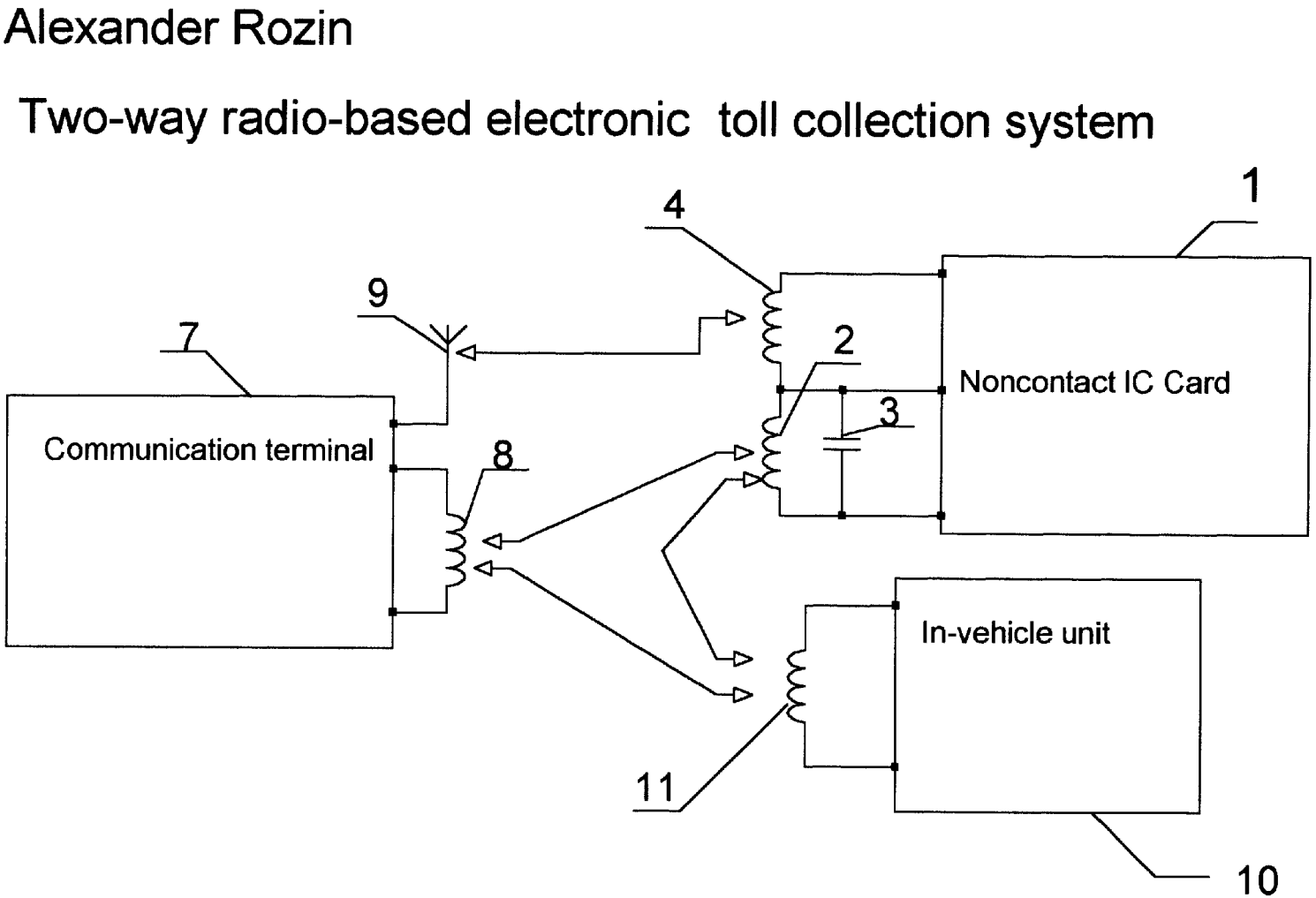
FIG. 1*a* and FIG. 1*b* are a block diagrams of a two-way radio-based electronic toll collection system comprising a noncontact IC card and a roadside communication terminal for use with noncontact IC card and an in-vehicle carried unit.
Figure 1B:
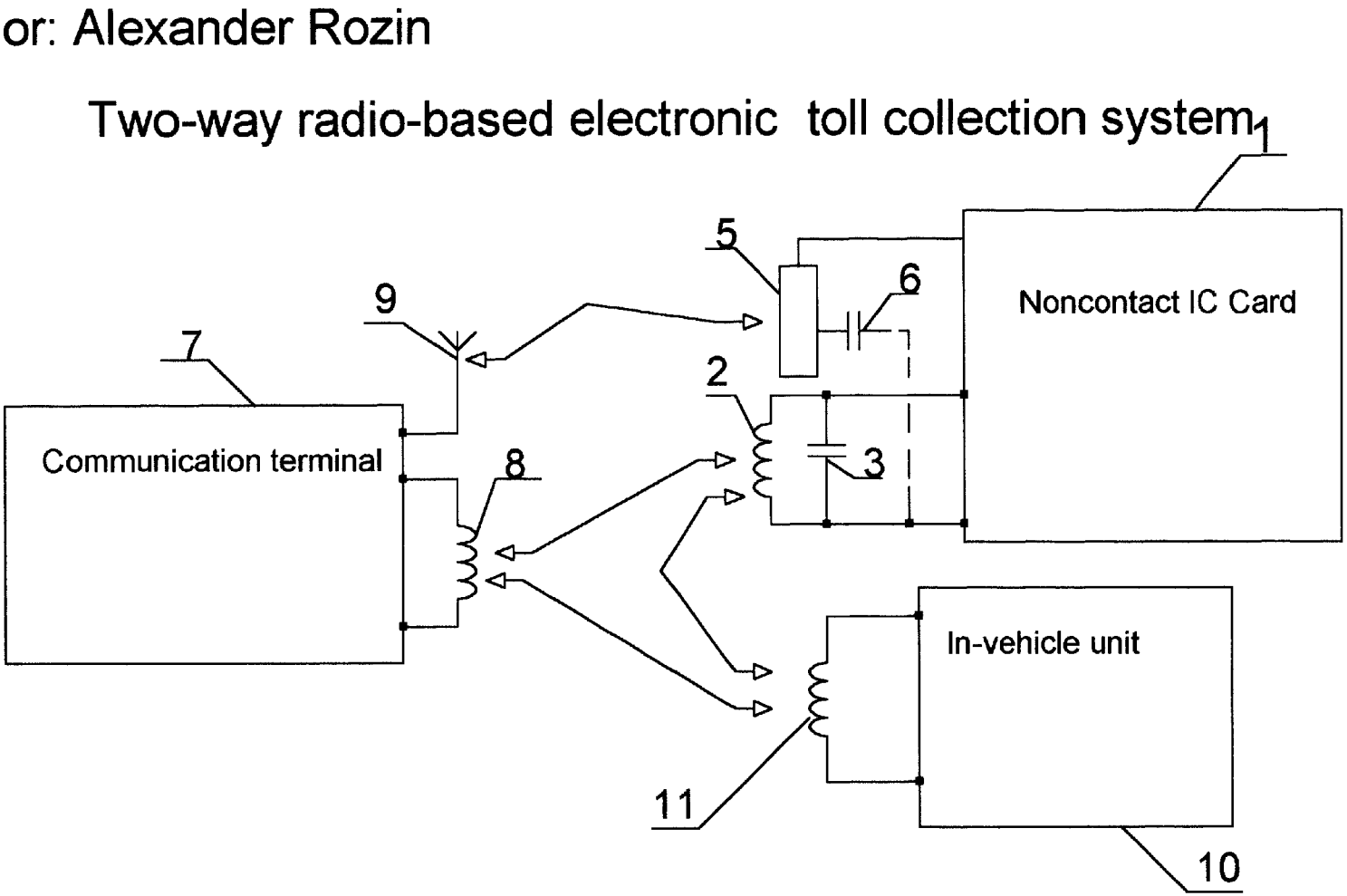
Figure 7:
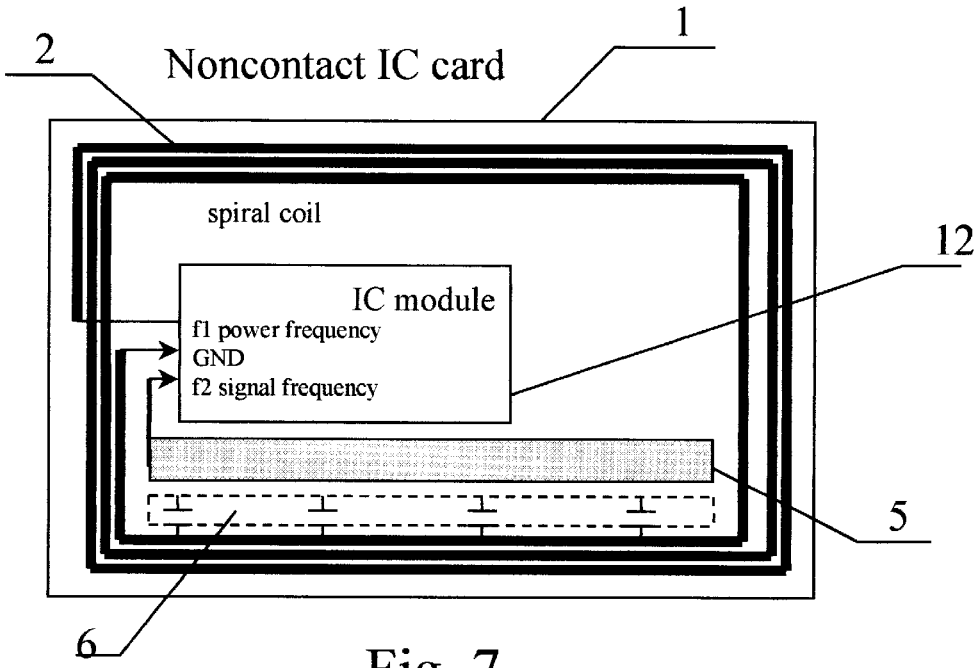
FIG. 7 is an exterior view of a second embodiment of noncontact IC card showing an etched coil antenna for power input and conductive stripe (microwave) antenna for data communication, and arranged on card the integrated circuit IC module according FIG. 1.

FIG. 1*a* exhibits a superposition of blocks in a two-way radio-based electronic toll collection system according to a first embodiment of invention which comprising: a noncontact IC card 1 having power antenna coil 2 in parallel alignment with capacitor 3 and data antenna coil 4 connected in series with parallel combination of coil 2 and capacitor 3. FIG. 1*b* presents a superposition of blocks in a two-way radio-based electronic toll collection system according to a second embodiment of invention wherein a second example of a noncontact IC card is realized; herein data antenna 4 comprises a conductive strip 5 having a resonant state with parameters of a strip's equivalent impedance (inductance) in series alignment with distributed capacitance 6 which is combined between said conductive strip 5 and inner line-turn of a said coil antenna 2. FIG. 7 shows this distributed capacitance 6 as well. The roadside communication terminal 7, comprising power antenna coil 8 and data antenna 9, respectively associated with roadside collection station, is arranged in either communication tower 43 or in communication stand 44 (as depicted on FIG. 8*a* and FIG. 8*b*). According to exemplary of invention depicted in FIG. 8*c* the roadside communication terminal 7 is arranged in a gate facility 45. In this FIG. G1 represents gates, respectively. Denotes by numeral 46 is a user of a gate facility, who possesses a noncontact IC card.

Figures 8A, 8B, 8C:
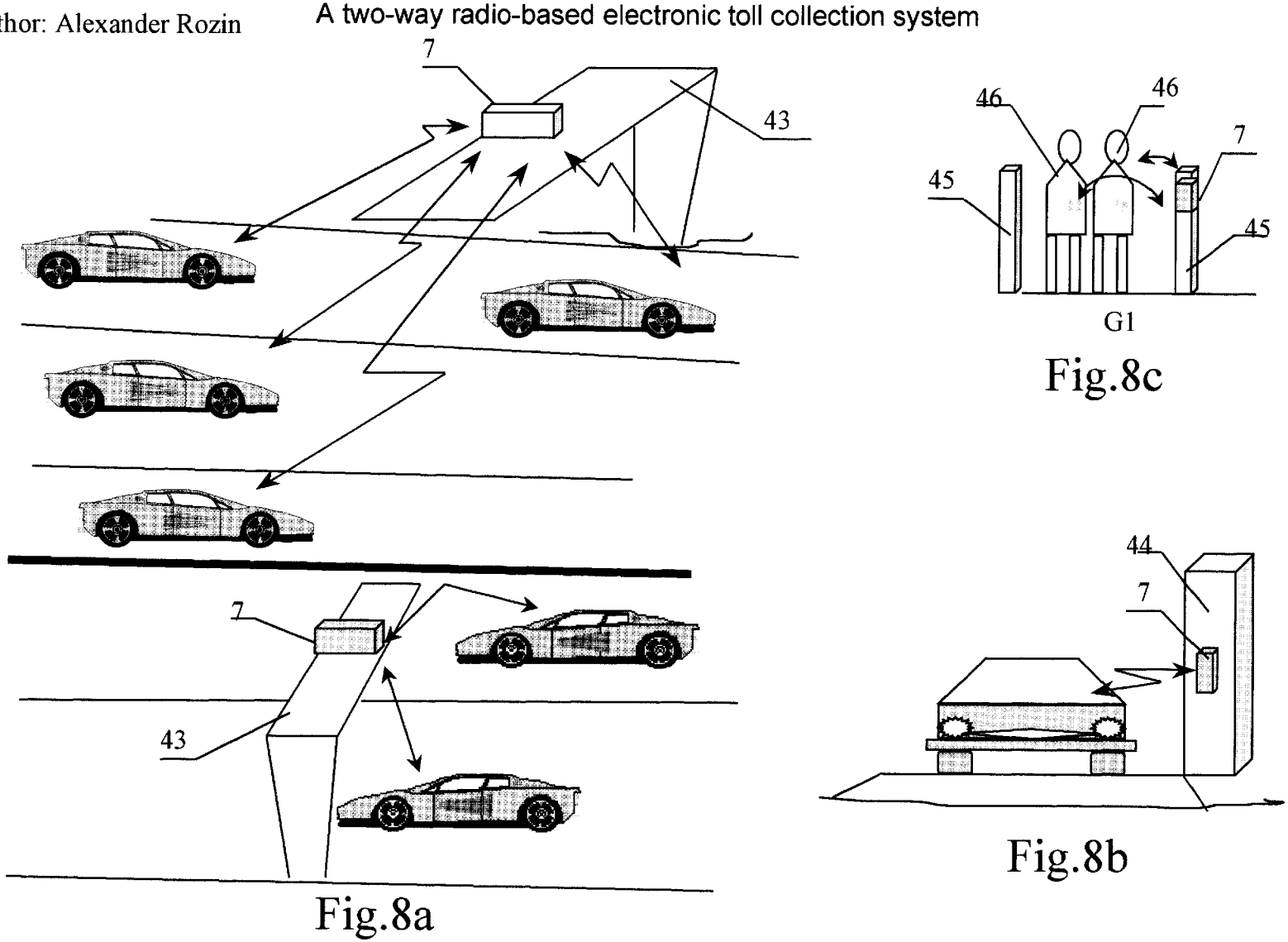
FIG. 8*a* is a perspective view of vehicles and a roadside collection station RCS on a highway.
FIG. 8*b* depicts a view of vehicle at a parking gate.
FIG. 8*c* represents a view of gate facility with people to which the noncontact IC card system according to exemplary of invention is applied.

An in-vehicle unit 10 having a coil antenna 11 is designed to supply with additional portion of an energy-transmitting alternating field the noncontact IC card 1 in order to provide a regular IC card operation in the case when a roadside communication terminal 7 is arranged so far from a moving vehicle (FIG. 8*a*). In the event when a roadside communication terminal 7 is arranged proximate near of a vehicle (FIG. 8*b*), the in-vehicle unit 10 do not supply the card with additional energy. Respectively the frequency of an energy-transmitting alternated field radiated by roadside communication terminal 7 is in coincidence with a parallel resonance of a on-card antenna circuit in applications when terminal is in near proximity to noncontact IC card, and in applications wherein a communication terminal is located distantly from a noncontact IC card the roadside communication terminal 7 radiates a substitute frequency for in-vehicle unit 10 to let him recognize that vehicle reached the capture area to provide toll operations.

Figure 2A:
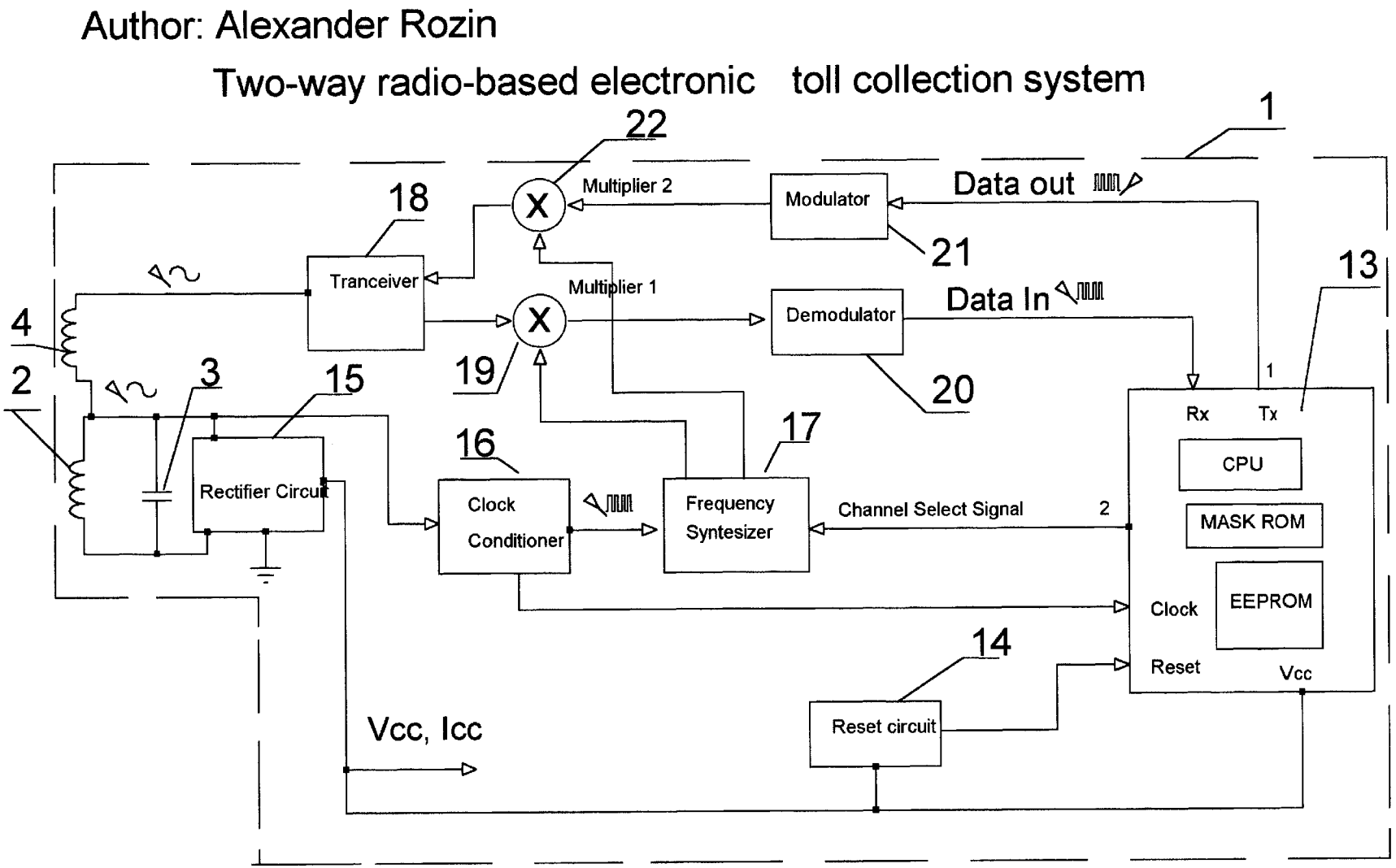
FIG. 2*a* is a block diagram of noncontact IC card in accordance with first embodiment of present invention.
Figure 2B:
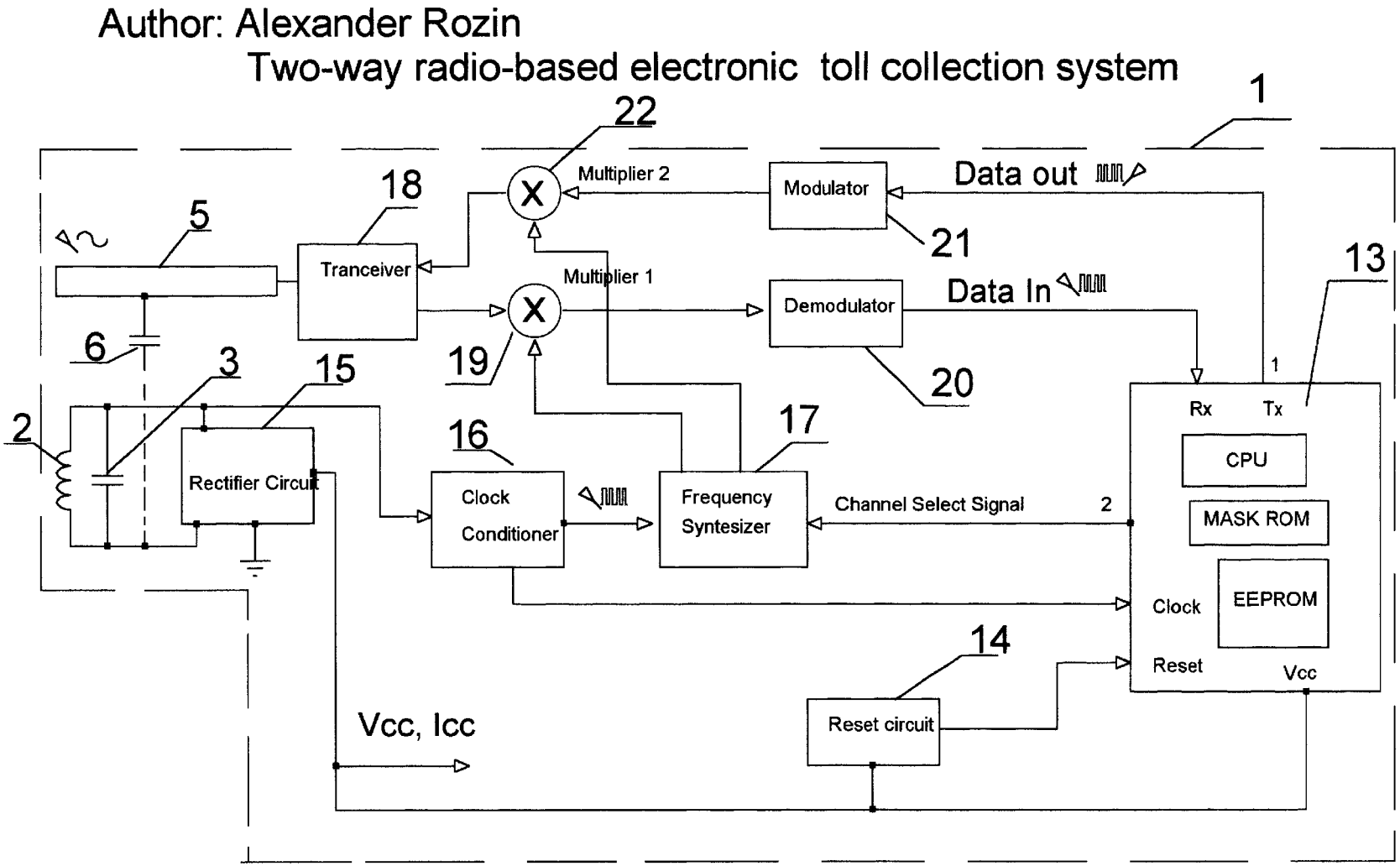
FIG. 2*b* is a block diagram of noncontact IC card in accordance with second embodiment of present invention.
Figure 6:
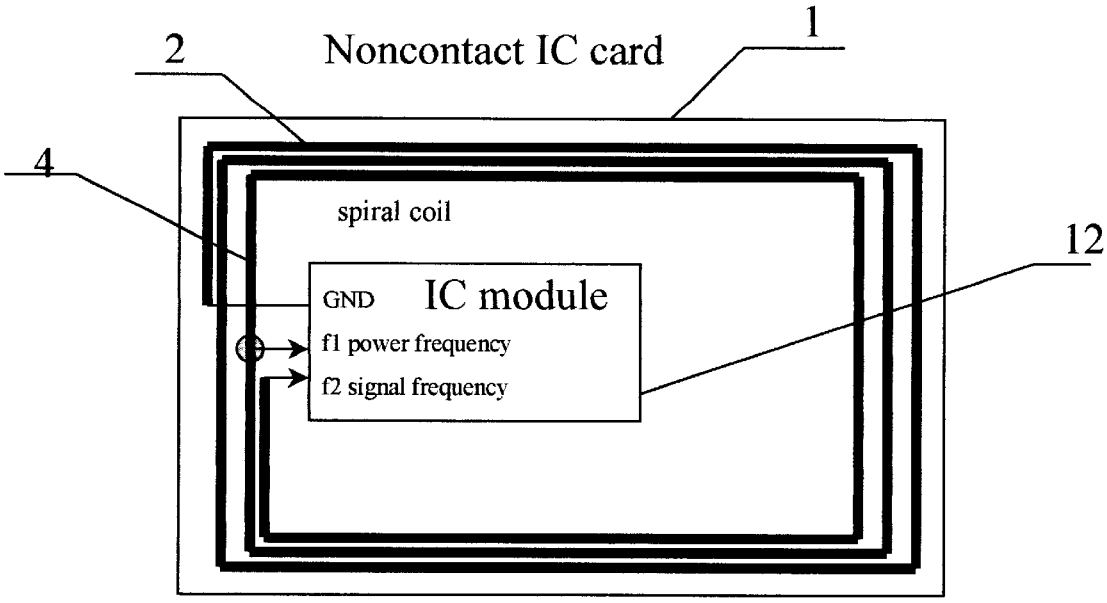
FIG. 6 is an exterior (perspective) view of a first embodiment of noncontact IC card, showing two an etched coil antennas as for power and data communication and arranged on card the integrated circuit IC module, comprising electronic circuit according FIG. 1.

FIG. 2*a* shows the basic block diagram of a first embodiment of noncontact IC card 1, comprising power antenna coil 2 in a parallel alignment with capacitor 3, data antenna coil 4 connected in series with parallel combination of coil 2 and capacitor 3. FIG. 6 depicts a schematic plan view of a spiral coil according first embodiment wherein the coil may be etched, wound, embedded, printed or produced in any other process known in the art. Herein the coil antenna is separated electrically (mechanically it is continual wire) to two parts: coil 2 having more turns for operation in parallel resonant mode and designed to receive the energy-transmitting alternating field (power supply) and coil 4 having less turns for operating in series resonant mode to provide the data communication. FIG. 6 shows the arranged on the card an integrated circuit IC module 12, comprising electronic components according FIGS. 2*a* and 2*b*. An antenna coil 2 according FIG. 7 is designed solely for receiving the energy-transmitting alternating field (power supply). The production process of it is similar to the coil of FIG. 6. The conductive strip 5 (see FIG. 1*b* and FIG. 7) in combination with a distributed capacitance 6 is designated to combine microwave antenna for data transmission/receiving and employee series resonant circuit. The functional block diagram of embodiment according FIG. 1*b* and FIG. 7 is depicted on FIG. 2*b* and it differs from FIG. 2*a* in replacing of spiral coil 4 to conductive strip 5 in series alignment with distributed capacitor 6.

In reference to the FIG. 6 the inductance of a coil 4 is designed to be much smaller than inductance of a coil 2, therefore a parallel resonant circuit, created by antenna coil 2 and capacitor 3 (see FIG. 2*a*), occurs on a lowest frequency than a series resonant frequency of a circuit combined by serial alignment with antenna coil 4 and capacitor 3. Accordingly, at the lowest operating frequency f1, which is designed for power transfer into the card, the antenna coil 4 exhibit a low impedance conductive element and does not effect on a parallel resonant circuit operation and does not cause on a flowing current. In contrast, at the higher operating frequency f2, which is designed for data transmission, the antenna coil 2 impedance becomes to be significantly large and do not effect considerably on series resonant circuit operation.

Second embodiment of a noncontact IC card 1 (see FIG. 7) is different from a first embodiment in design of an antenna circuit for data communication which comprises a conductive strip 5 having a resonant condition as of strip's equivalent impedance (inductance) in series alignment with distributed capacitance 6 which is combined between said conductive strip 5 and inner line-turn of a said coil 2 of antenna.

The parallel resonant circuit combined by coil 2 and capacitor 3 presents a high impedance resulting in a large voltage with a small current flow accordingly deriving operating power from a signal transmitted by roadside terminal 7 or retransmitted by in-vehicle unit 10. The series resonant circuit formed by the parallel combination of coil 2 and capacitor 3 in serial alignment with coil 4 presents a low impedance, which results in a large current having a small applied voltage at the data transmit/receive frequency f2 thus enabling to enlarge the distance of a backward transmission to a terminal 7.

Furthermore the noncontact IC card 1 comprises a microprocessor 13 with memory to store data and programs, a reset circuit 14, a rectifier circuit 15 to rectify alternating voltage generated by antenna coil 2 at frequency f1. Moreover the noncontact IC card 1 includes clock conditioner 16, frequency synthesizer 17, transceiver 18 connected to radio-frequency (referred afterward as RF) antenna which may be, as mentioned above, either coil 4 or strip 5. In addition the noncontact IC card 1 comprises a first frequency multiplier 19 which output is connected with input of demodulator 20 which predetermined to demodulate the data transmitted from roadside terminal 7 and to input this data signal into microprocessor 13. The output of demodulator 20 is connected to the first input ( referred as Rx) of said microprocessor 13. The series arrangement of modulator 21 and frequency multiplier 22 is connected to the first output (referred as Tx) of microprocessor 13 and predestined for modulation of outputted carrier radio-frequency with a data signal produced by microprocessor 13. Clock conditioner 16 serves to supply the regular work of microprocessor 13 (input 2 referred as Clock) with synchronized pulse signal, and to provide a frequency synthesizer 17 with a stable frequency reference which is synchronized by road communication terminal 7 as a carrier frequency of an energy-transmitting signal. Alternating voltage generated by antenna coil 2 at frequency f1 is applied to a clock conditioner 6 which produces a shaped signal of the same frequency. Reset circuit 14 connected with a rectifier circuit 15 provides reset signal to microprocessor 13 (input 3 referred as Reset) when supply voltage arise and thereafter the microprocessor 13 starts it's normal operation. All card electronic components are fed with a power supply voltage produced by a rectifier circuit 15.

Frequency synthesizer 17 along with first and second frequency multipliers 19 and 22 in alliance with demodulator 20 and modulator 21 are predetermined to provide a noncontact IC card 1 with a performance of spread-spectrum communication technique. This technique is well known in the art and in general may be realized like Direct Sequence Spread Spectrum (DSSS) or Frequency-Hopping Spread Spectrum (FHSS) as referred in Wireless Informational Networks/ Kaveh Pahlavan, Allen H. Levesque, 1995, John Willey&Sons, Inc., ISBN 0-471-10607-0. Hereafter we shall explain the preferred embodiment taking a frequency-hopping spread spectrum technique (FHSS) as an example of application. Herein the carrier frequency of the digitally modulated data is hopped over a wide range of frequencies prescribed by a periodic pseudo-random (PN) code. In the preferred embodiment the prescribed code is synchronized by microprocessor of a roadside communication terminal 7 and therefore the hopping patterns are selected so that two users of a noncontact IC card never hop to the same frequency at the same time, and thus the multiple-user interference, collisions and interceptions are eliminated. The number of users is limited by the number of frequency slots. The type of modulation of carrier hopping frequency may be similar to any one of the utilized in the art, for example: frequency shift keying (FSK), phase shift keying (PSK), quadrature phase shift keying (QPSK), pulse amplitude modulation (PAM), and in general there is no special restriction to the form of signal modulation. In the disclosed embodiment modulators 21 (on card) and 34 (on terminal) and demodulators 20 (on card) and 32 (on terminal) employee one of the known modulations in the art and for that reason we do not discuss herein in details this process.

It is well known that at frequencies below 13.56 MHz it is possible to by limiting the distance between the terminal (Reader/Writer) and the card (transponder) to derive the energy for the contactless smart card from the radio waves. In disclosed embodiment the radiation of an energy-transmitting signal is provided at the low frequency having very narrow spectrum width in order to satisfy the restriction of appropriate Normative Documents (like FCC in USA), preferably this signal has to obtain a continuous sinus wave shape. Said energy-transmitting signal employee as a reference to synthesize at a higher band the communication channels with hopping frequencies in order to supply a several users with this communication resource at one time. As an example of design, the energy-transmitting signal has a frequency of 13.56 MHz and communication channels are arranged in first embodiment within 26.96–27.28 MHz, comprising a band width of 320 KHz, and in second embodiment within of any microwave bands having appropriate frequencies. Therefore the competing for a communication resource will be canceled along with avoiding the collisions, interceptions and interference.

Figure 3:
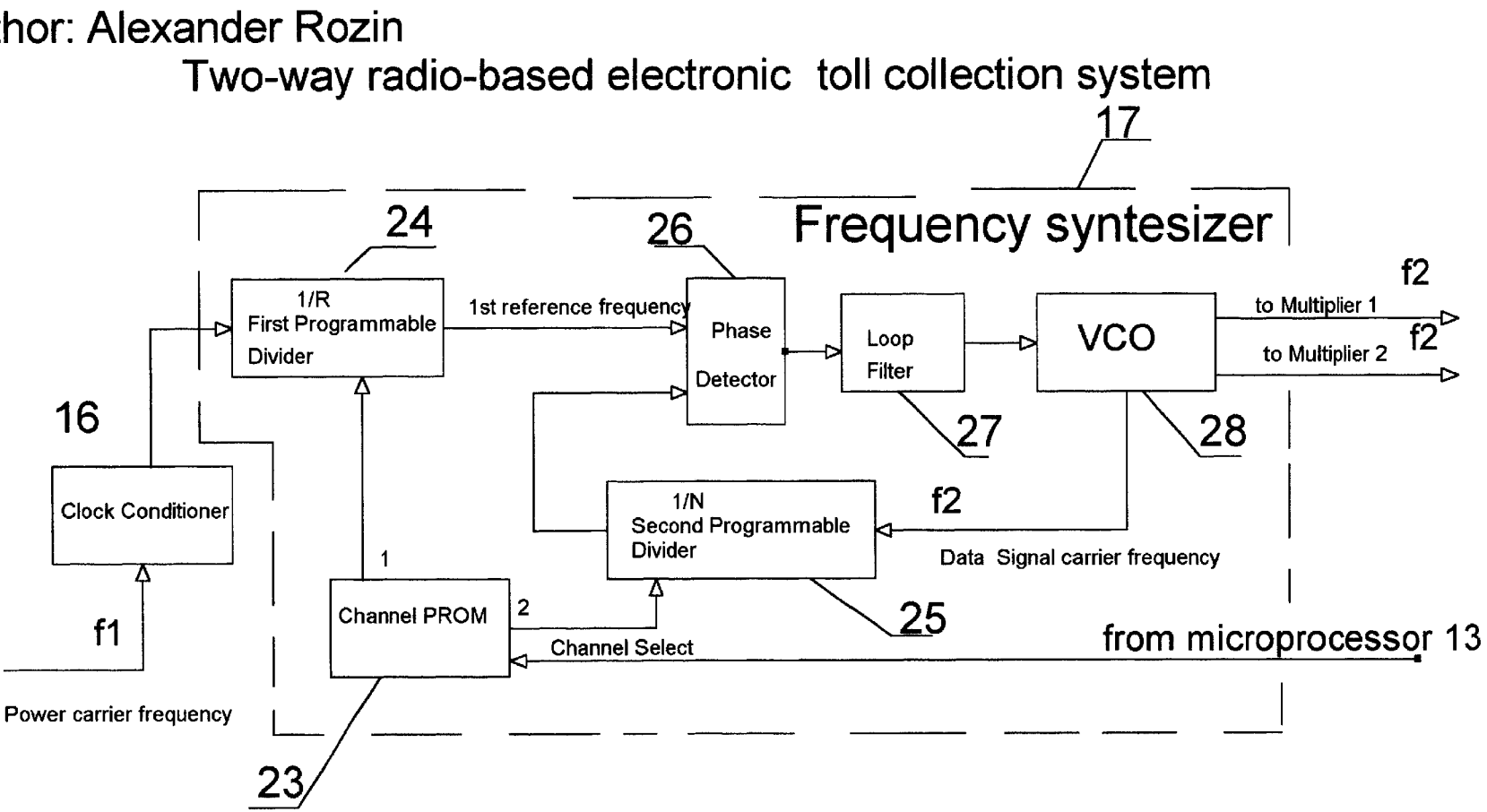
FIG. 3 is simplified block diagram of PLL frequency synthesizer of FIG. 1.

PLL frequency synthesizer is depicted at FIG. 3 and comprising channel PROM (programmable read only memory) 23, first programmable divider 24, second programmable divider 25, phase detector 26 in series alignment with lop filter 27, and voltage controlled oscillator VCO 28. First programmable divider 24 has a divide ratio 1/R, where R is defined by appropriate command of a channel PROM 23, which first output is connected with to first input of said divider 24. Second programmable divider 25 has a divide ratio 1/N where N is defined by appropriate command of a channel PROM 23, which second output is connected with to first input of said divider 25. First programmable divider 24 serves as reference divider to produce desired spacing frequency fref for frequency channels, and second programmable divider 25 is predestined to obtain a desirable frequency of VCO 28 as a carrier frequency for communication channels. The phase detector 26 detects the difference between the two frequencies outputted from dividers 23 and 24 in terms of the phase, and produces so-called error voltage and loop filter 27 integrates this phase difference to produce an output voltage other than zero proportional to error voltage. This voltage is used to control the frequency of a VCO and is made such that polarity forces the VCO to track on the direction of the input reference frequency. Ones the two frequencies are equal and coincident (coherent), the error voltage of phase detector 26 is zero and PLL is then said to be locked. Channel PROM 23 enables to make rapid settle of counting ratios R and N according to a signal of microprocessor 13 in order to provide fast hops of frequency in the predestined band.

Figure 4:
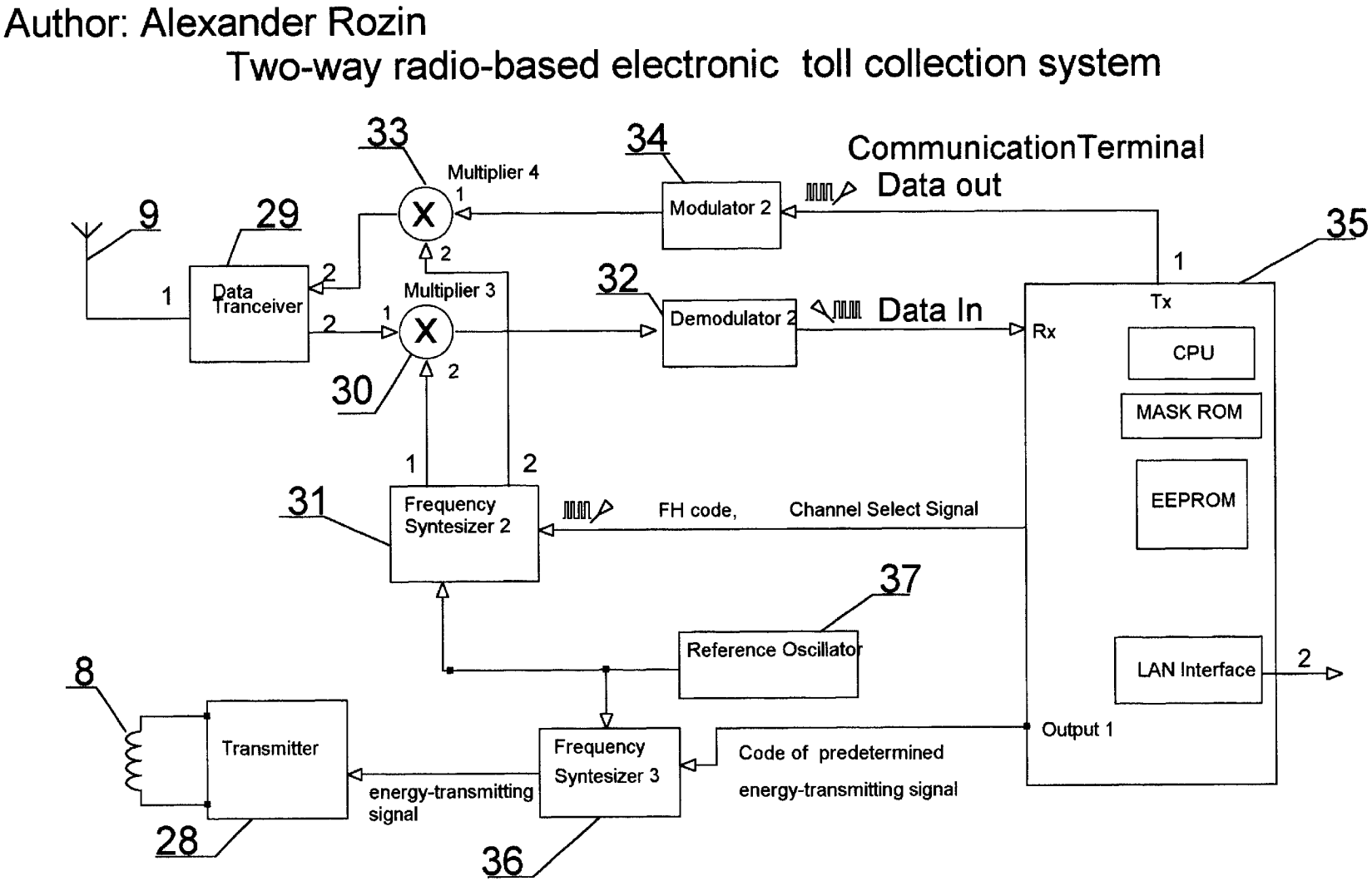
FIG. 4 is simplified block diagram of a communication terminal—a roadside collection station RCS combining function of a reader/writer device for noncontact IC card.

A communication terminal 7 shown on FIG. 4 comprises first transmitter 28 for radiation of an energy-transmitting signal through antenna 8, data transceiver 29 for transmission/receiving data signal through antenna 9, third frequency multiplier 30 which first and second inputs are connected respectively with second output of data transceiver 29 and first output of a first frequency synthesizer 31, and output of said multiplier 30 coupled with input of demodulator 32. Furthermore communication terminal 7 comprises a fourth frequency multiplier 33 which first and second inputs are connected respectively with output of modulator 34 and second output of a first frequency synthesizer 31, and output of said multiplier 33 is coupled with second input of data transceiver 29. Moreover a communication terminal 7 contains microprocessor 35, which output (referred as Tx) is connected with output of modulator 34 and input (referred as Rx) is connected with output of demodulator 32. The input/output (bidirectional port) of a microprocessor 35 (referred as LAN) is connected with appropriate port of next microprocessor 7 to combine local area network (LAN) in the event that toll gates comprise several communication terminals to provide high capacity of coexisting passages for noncontact IC card possessors, for example underground toll gates, or multi line highway. In addition LAN port of microprocessor 35 provide communication with a host plaza computer (not shown on the drawings) to enable complete toll charge and other financial operations. Furthermore a communication terminal 7 comprises a second frequency synthesizer 36 to provide carrier frequency of an energy-transmitting alternating field and reference oscillator 37 performing a reference frequency for synchronization of said first and second frequency synthesizers 31 and 36 as well as the every of frequency synthesizers comprised and operating in a two-way radio-based electronic toll collection system and arranged within IC cards.

A communication terminal 7 operates as follows. Microprocessor 35 produce a code of a predetermined frequency of an energy-transmitting signal f1, which frequency is defined by a current acting federal restrictions in this zone or country and by a particular application of a two-way radio-based electronic toll collection system. For example, on a highway toll gate (see FIG. 8*a*) wherein communication terminals are placed distantly from a passing vehicles, the carrier frequency $f1^1$ of an energy-transmitting signal may be either less than 1 MHz or about 100 MHz, or above, and serves like a substitute of an energy-transmitting signal f1 to synchronize the in-vehicle unit 10 which regenerates the energy-transmitting alternating field in order to power the noncontact IC card. Next example, parking collection (see FIG. 8*b*) wherein a vehicle is proximate to toll gate, the carrier frequency f1 of an energy-transmitting signal may be either less than 1 MHz, a several MHz or 13.56 MHz that is permitted by restrictions and therefore a radiated a signal has enough strength to power directly a noncontact IC Card. Herein the in-vehicle unit measures the field strength of an energy-transmitting signal f1 and do not regenerate the energy-transmitting signal because the source signal has enough strength to power IC card. Additional example is shown at FIG. 8*c,* wherein a several persons are passing through the underground toll gate. Herein a card possessors are proximate to communication unit 7 which radiates an energy-transmitting alternating field at frequencies of a permitted band, let's say 13.56 MHz for example, and people have no any necessity to handle in-vehicle unit or like. Hence, the carrier frequency f1 of an energy-transmitting signal is always set up by program of microprocessor 35 in accordance with the application circumstances.

Figure 5:
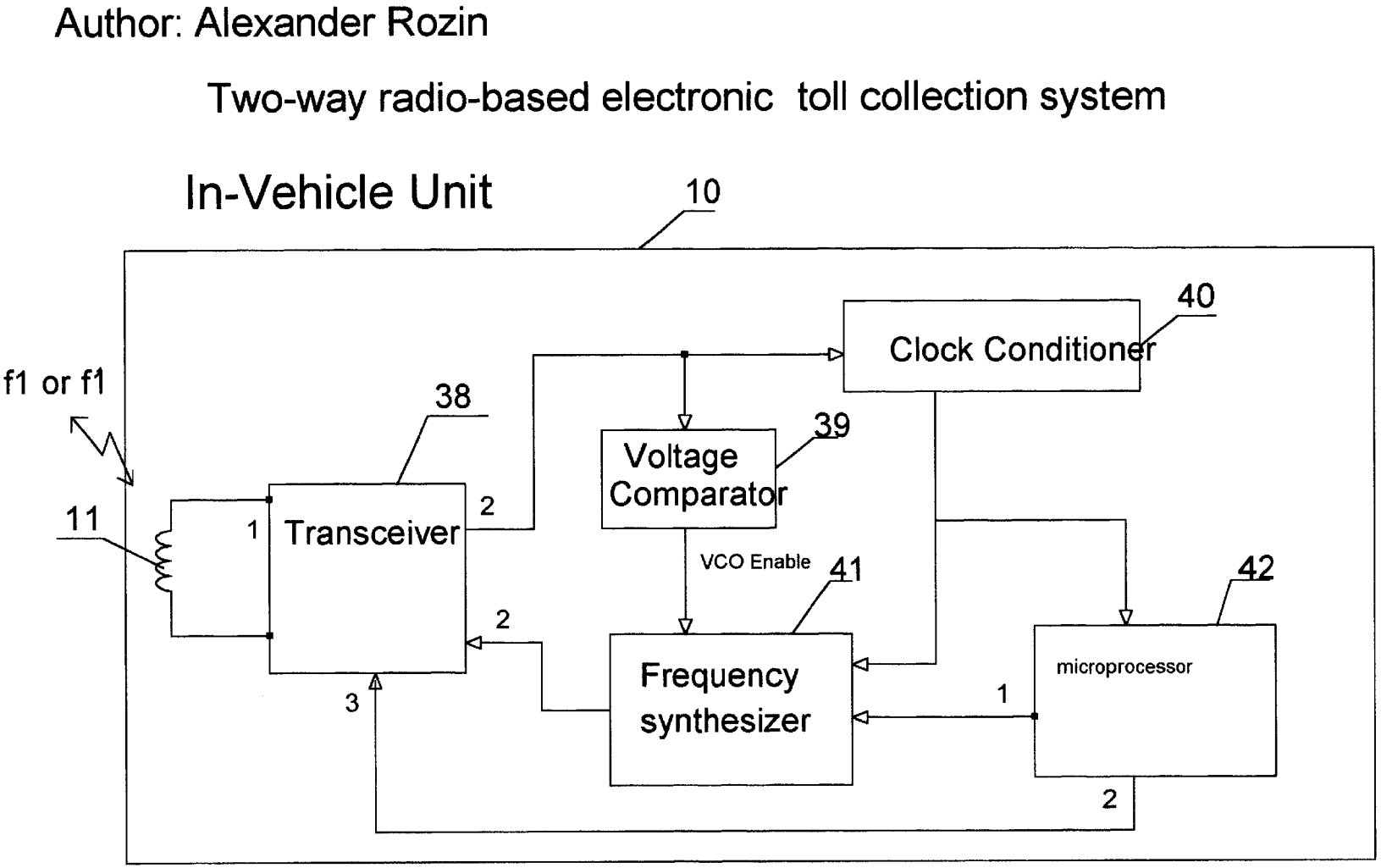
FIG. 5 is a block diagram of in-vehicle unit.

In-vehicle unit 10 illustrated on FIG. 5 comprising transceiver 38, voltage comparator 39, clock conditioner 40 and frequency synthesizer 41 (performs PLL frequency synthesizer), and a microprocessor 42 to settle the frequency of an energy-transmitting signal. In details, in the occasion of the utilization of noncontact IC card 1 having a parallel resonant circuit tuned to 125 kHz for deriving the energy, the microprocessor output code installs the frequency synthesizer to produce f1 of 125 kHz, and in the event of the utilization of noncontact IC card 1 having a parallel resonant circuit tuned to 13.56 MHz for deriving the energy, the microprocessor output code installs the frequency synthesizer to produce f1 equal to 13.56 MHz. For this purpose the antenna 11 comprises three different coils, not illustrated on FIGS. 1 to 10 as it is well known design. This design enable to operate within a wide spectrum of a frequencies (hundreds of kilohertz as the first band and several megahertz to 13.56 MHz as the second band). In order to provide resonant mode of antenna 11 has an appropriate capacitors arranged within transceiver 38 and as this technique is well known we do not complicate with description of this circuit. The second output of a microprocessor 42 guides the transceiver 38 to switch the appropriate coils to the output cascade. Voltage comparator 39 is designed to verify strength of a received energy-transmitting electromagnetic field from roadside terminal 7 and to produce a signal to enable the oscillation of internal VCO (not shown separately from frequency synthesizer since it is well know element) of the frequency synthesizer 41. A clock conditioner 40 serves to provide a frequency synthesizer 41 with a shaped stable frequency reference which is derived from a synchronized substitute signal $f1^1$ radiated by road communication terminal 7. Moreover this signal outputted from clock conditioner 40 is examined in a microprocessor 42 to calculate the control codes to set frequency synthesizer 41 and transceiver 38.

The receiving part of transmitter 38 scrolls the appropriate frequency band to select and recognize the energy-transmitting alternating field f1 or it's substitute $f1^1$. When any signal is detected the voltage comparator 39 provide verification of a strength of received signal and in the event of a low voltage level comparator 39 enables the frequency synthesizer 41 to work. This low level is associated with $f1^1$, and high level is associated with f1.

A two-way radio-based electronic toll collection method and appropriate system operate as following.

The first step is to provide with communication terminal having capability of radiation an energy-transmitting signal in one band and frequency hopping ability in the other band in order to establish communication link for data transfer.

The second step is furnishing with a noncontact card capable to derive power supply voltage from an energy-transmitting alternating field. Next step is to support an IC card with a frequency hopping ability to establish communication link for data transfer.

Additional step is furnishing a moving object with an in-vehicle unit capable to measure the strength of an energy-transmitting signal and regenerate energy-transmitting signal when necessary.

Figure 9A:
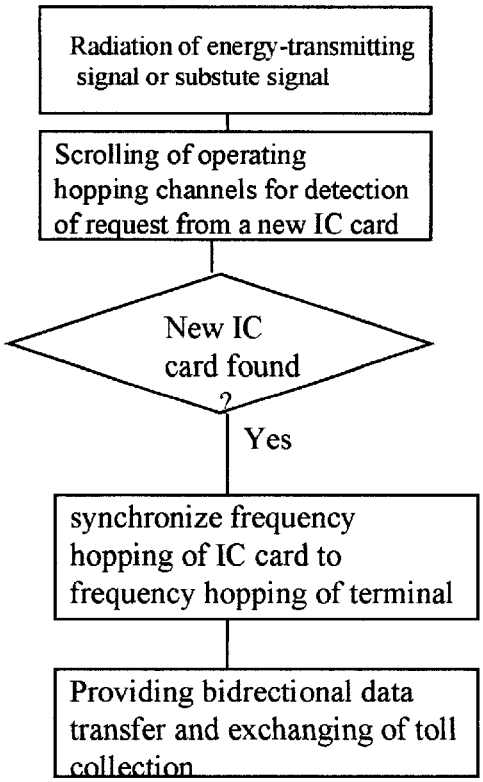
FIG. 9*a,* FIG. 9*b* and FIG. 9*c* illustrate a method of a system operation in accordance with an embodiments of the invention.

In details, referring to the FIG. 9*a* depicting operation of a communication terminal 7, a radiation of an energy transmitting present continuously in a toll-gate area when a distance between terminal 7 and moving vehicle or other possessor of a noncontact IC 1 card allows to provide adequate energy transfer to power IC card 1. In the event of big distances, that relates essentially to high-ways, a terminal 7 radiates a substitute signal telling when detected that a vehicle have reached a toll-gate capture area. Simultaneously the terminal 7 provide scrolling of operating hopping channels to detect request from a new noncontact IC card when entered into capture area. When new IC card is found, the terminal 7 transmits code of hopping sequence to synchronize communication up-and-down link along with transmission of an appropriate information for authentication, security and toll charge.

Figure 9B:
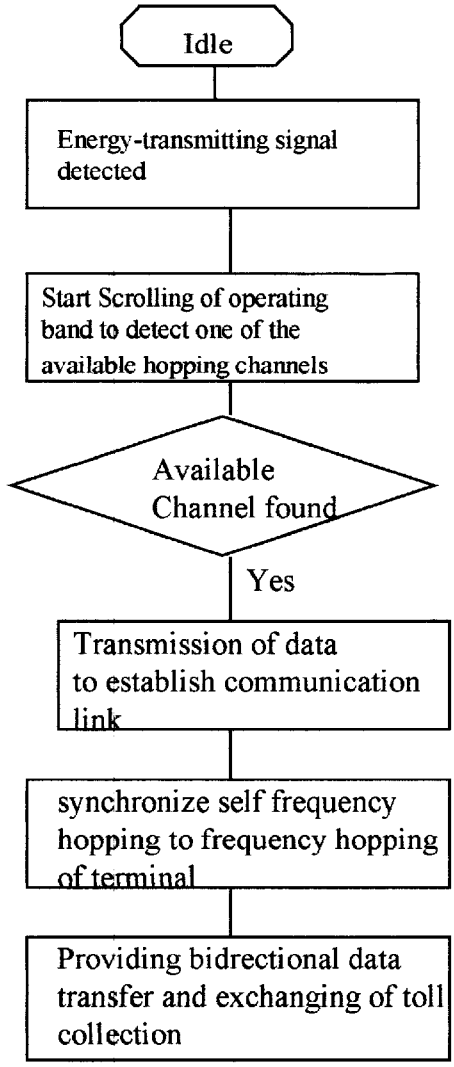

FIG. 9*b* illustrates the operation of an noncontact IC card 1. Before receiving energy-transmitting signal an IC card is idle. After an energy-transmitting signal is received and detected, the card is powered and starts to scroll the operating frequency band to detect one of the available channels. Afterward this channel is found the card transmits a request to establish a communication link. This request contains all necessary authentication data to recognize the IC card. Since the code of hopping sequence for synchronization of a communication link is received, the IC card 1 provides tracking to frequency hopping channels and data interchange occurs within this said channels. The command to hop is transmitted by terminal 7 by one of the known methods, for example each packet of data from terminal 7 is added with a channel code for next packet of information to be inputted in or outputted from IC card. Accordingly the bi-directional data transfer and toll collection are provided. In the cause of a small balance amount of a prepaid on-card value, the data with debt amount and bank account of this particular toll collection station-creditor is recorded into the IC card memory. Next time as the card is inserted to be recharged into ATM machine, the last makes automatically money transfer to a creditor.

Figure 9C:
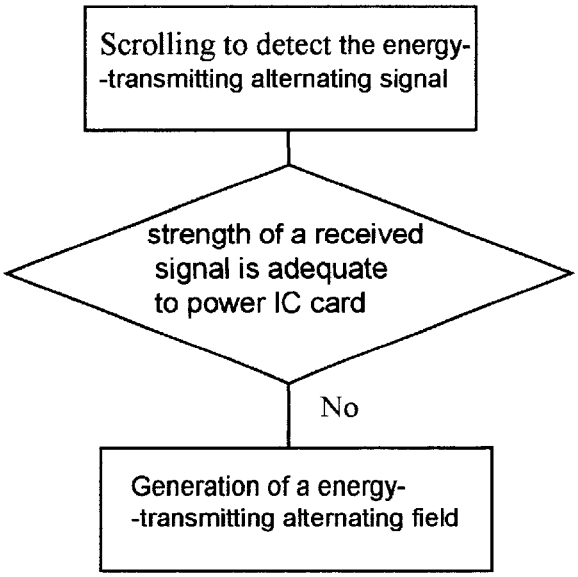

FIG. 9*c* illustrate the operation of in-vehicle unit 10, which scans to detect the energy-transmitting alternating signal. Afterwards the signal is found, the in-vehicle unit 10 makes an analyze whether is it an energy-transmitting signal by measuring the strength of alternating field. If the strength is adequate to power a noncontact IC card 1, the in-vehicle unit keeps quiet and do not generate. If the strength of received signal is less then required in that case it is considered to be the substitute signal, and the in-vehicle unit regenerates the energy-transmitting signal of predestined frequency which is synchronized with said substitute signal.

Since an untraceable electronic check which communicate in a cryptographically sealed envelope with opener is a well known process we do not discuss this procedure in details. Transaction linkage data is utilized in each phase of the complete toll payment transaction to facilitate simultaneous multi-lane RCS/IVU operation. A plaza computer local area network with downlink communication terminal controller is also used to facilitate simultaneous multi-lane transactions As a result the invention allows to merge the convenience of a conventional noncontact radio frequency cards with advanced performances of a complicated apparatuses, like present modern an in-vehicle units for automatic toll collection, comprising functions of a reading/writing from IC cards and transmitting payment information to a distant road collection station. Herein the operating distance is increased and the simultaneous stable non-collision and non-interference operation of a several cards is provided. Furthermore the hopping communication channels support the preventing of interception and easy decoding and deciphering of radio-frequency signal with an attempt of a tempering.

Moreover, the present invention shortens the time of passing through the toll gates, because if prepaid balance is not enough to pay, the debt is recorded into the IC card memory and the next card entering into an ATM machine is accompanied with payment of all previous debts. Besides, the eliminating of reader/writer functions from in-vehicle unit prevents a possibility of hacking of in-vehicle unit with a purpose to avoid reader/writer and send a fraud information about money transfer.

Next advantage of a preferred embodiment is versatility of the noncontact IC card which may, like present modern IC cards do, to store prepaid value, keep the balance and refund debt automatically while the next operation of money charging into card occurs. The same card may be used in many applications with and without the in-vehicle unit like in automatic vehicle identification, parking, in real-time highway toll collection systems, in public transportation for fare collection, and remote authentication.

Additional advantage of a preferred embodiment is that it provides a low cost solution of a system, because the noncontact IC card is built using the already created inexpensive production technology of internal spiral coil antenna for conventional economical and standard RF Cards. Using the same technology the printing of a conductive strip antenna do not add significant price.

The other advantage of a preferred embodiment is a low cost of in-vehicle unit as it does not participate in data transmission, reading/writing from/to the card and balance calculation, and all gadget displays are eliminated.

The non-contact IC cards used in such a systems are considered to be a conventional size and, in general, a noncontact card has the shape of a portable member and a size generally equal to that of ordinary magnetic cards having internal coil antenna formed as a spiral copper foil pattern by etching or the like.

What is claimed is:

1. Two-way radio frequency (RF) data exchange method utilizing a remote RF communication terminal and a noncontact smartcard operable to communicate with said terminal within interrogate area, the method comprising the steps of:

radiation by a remote RF communication terminal of an energy-transmitting signal at first predetermined frequency, which is being modulated by a first data signal, and moreover generating and transmitting by a remote RF communication terminal of first communication hopping channels for transfer and interchange of second data signal, and receiving by a remote RF communication terminal of second communication hopping channels transferring a response data signal produced and generated by said smartcard, and wherein first and second communication hopping channels operating respectively by means of carrier hopping frequencies modulated correspondingly by second data signal and a response data signal, and wherein both second data signal and a response data signals containing a specific encrypted identification information, and an encrypted electronic value transfer information, and wherein first communication hopping channels combining respectively a plurality of downlink channels for transmission of second data signal from a remote RF communication terminal to a noncontact smartcard while simultaneous operation of numerous noncontact smartcards when last are disposed at interrogate area in the same time, and wherein second communication hopping channels are combining respectively a plurality of uplink channels for transmission of a response data signal while simultaneous operation of numerous noncontact smartcards when last are disposed at interrogate area in the same time, and wherein a plurality of downlink and uplink channels are predestined and designed to operate in frequency hopping mode with a purpose to prevent collisions, interference and data interception of both second and response data signals while simultaneous operation of numerous smartcards when last are disposed at interrogate area in the same time, and additionally steps of:

disposing of first communication hopping channels in a frequency bandpass which is located apart from first predetermined frequency, and disposition of second communication hopping channels in a frequency bandpass which is located apart from first predetermined frequency, and moreover disposition of second communication hopping channels in the same frequency bandpass as first communication hopping channels, and furthermore using first predetermined frequency to employ a reference to synthesize and synchronize a carrier hopping frequencies of said communication hopping channels, and wherein first data signal contains a control codes designed to synchronize a hope transitions of a separate carrier frequencies within said communication hopping channels in order to prevent collisions, interference and data interception between said channels, and additionally performing by a noncontact smartcard the following operations comprising:

receiving of an energy-transmitting signal radiated by remote RF communication terminal at first predetermined frequency and then deriving an induced electric energy thereof in order to power the noncontact smartcard, and detecting and extracting of said control codes from an energy-transmitting signal, which codes comprising an information about available and an assigned communication hopping channels, and further:

selecting and assignment of one of available to communicate among downlink channels and one of available to communicate among uplink channels to perform a personal downlink channel and a personal uplink channel, and afterward synthesizing and generating by said noncontact smartcard a personal downlink channel for receiving second data signal produced by said remote RF communication terminal, and producing of a response data signal comprising a specific encrypted identification information, and an encrypted electronic value transfer information, and consequently synthesizing and generating by said noncontact smartcard a personal uplink channel out of a plurality of uplink channels for transmission of a response data signal produced by said noncontact smartcard, and moreover providing steps of:

deriving and recovering of first predetermined frequency out of an energy-transmitting signal, and further using of said recovered first predetermined frequency as a reference to synthesize and synchronize a carrier hopping frequency of an assigned personal uplink and downlink channels, and additionally performing a control and synchronization of a hope transitions of said carrier hopping frequencies by means of said control codes being a component of first data signal, which codes are detected by said smartcard from an energy-transmitting signal, and designing and maintaining a sequence of hope transition of first and second communication hopping channels in synchronous mode to prevent the hop to the same carrier frequency of two smartcards at the same time.

2. Two-way radio frequency (RF) data exchange method of claim 1, wherein a noncontact smartcard performing operations of:

scanning of the frequency bandpass occupied by first communication hopping channels with a purpose to detect and select an available free communication hopping channel when said control codes are absent or not obtainable after detecting of first predetermined frequency of an energy transmitting signal, and:

detecting, selecting confirming and assignment of an available free communication hopping channels with a purpose to perform a personal downlink channel and a personal uplink channel, and synthesizing and generating of the assigned to communicate a personal downlink and a personal uplink channels for corresponding receiving and transmitting of second and a response data signals, and wherein the selecting and assignment of an available to communicate communication hopping channel is provided in compliance with preventing the hop to the same carrier frequency for two smartcards at the same time, and wherein both second data signal and a response data signal contain a specific identification information relating respectively to remote RF communication terminal and to a noncontact smartcard, and accordingly to an electronic value transfer information.

3. Two-way radio frequency (RF) data exchange method of claim 2, comprising steps of:

providing a noncontact smartcard with an antenna module exhibiting a parallel resonant mode at first predetermined frequency and a series resonant mode at a frequency bandpass occupied by both first and second communication hopping channels, and:

deriving the maximum voltage from the energy-transmitting signal at the parallel resonant mode predetermined for powering of a noncontact smartcard, and receiving of second data signal and transmitting of a response data signal using the series resonant mode predetermined and designed to increase the power of a response data signal transmitted via uplink channel back to remote RF communication terminal and therefore to increase a space and operating distance of the communication hopping channels and moreover providing operations of:

selecting and designing of a predetermined frequency difference between parallel and series resonant modes with a purpose to provide an electrical separation and an electromagnetic decoupling inside of the antenna module between an energy-transmitting signal and the communication hopping channels in order to avoid parasitic intermodulation and distortions caused by the energy-transmitting signal, and additionally to prevent collisions of a transmitted and received data signals, and moreover selecting and designing of said frequency bandpass to be significantly higher than first predetermined frequency with a purpose to provide a necessary width of a passband for allocation of a numerous hopping communication channels, and additionally selecting and designing of the frequency bandpass to be significantly higher than first predetermined frequency with a purpose to provide a small and portable dimensions of an antenna module.

4. Two-way radio frequency (RF) data exchange method as claimed in claim 3, predetermined and designed to provide a vehicle identification and a toll collection, comprising steps of:

arranging a remote RF communication terminal at a roadside toll collection area and disposition of a noncontact smartcard within a vehicle, and providing and maintaining by means of a remote RF communication terminal a vehicle identification, an electronic fund transfer and toll collection, and moreover verifying of an electromagnetic field strength of said energy-transmitting signal at a noncontact smartcard location area with a purpose to check whether the field strength is enough to induce an electric energy which is adequate to power the noncontact smartcard, and regenerating of an extra portion of energy-transmitting alternating field at a noncontact smartcard location area with a purpose to power the noncontact smartcard if the field strength of energy-transmitting signal radiated by remote RF communication terminal is not enough to induce an electric energy adequate to power the smartcard, and furnishing with a special in-vehicle unit designed to perform said operations of receiving, verifying and regeneration an extra portion of energy-transmitting alternating field if the energy, induced by signal radiated by remote RF communication terminal is not enough to power the smartcard, and additionally:

arranging said noncontact smartcard proximate to said in-vehicle unit, and wherein said noncontact smartcard operable to communicate with both said terminal and with an in-vehicle unit.

5. Two-way radio frequency (RF) data exchange method as claimed in claim 4, comprising steps of:

selecting and assigning of the first predetermined frequency of an energy-transmitting signal radiated by a remote RF communication terminal to be different to the frequency of a parallel resonant mode exhibited by a noncontact smartcard antenna module in the case when a toll collection area is predetermined for vehicles passing far away of a roadside RF communication terminal at a distance range disallowing to induce directly an electric energy sufficient to power the smartcard, and additionally providing the operations of:

receiving and verifying an electromagnetic field strength of first predetermined frequency by means of in-vehicle unit, and further performing of a regeneration of an extra portion of an energy-transmitting alternating field at second predetermined frequency which is designed to correspond to a parallel resonant mode of a noncontact smartcard antenna module with a purpose to induce an electric energy sufficient to power the smartcard, and:

synthesizing and synchronization of second predetermined frequency by using the first predetermined frequency employing a reference signal, and wherein a noncontact smartcard providing operations of:

scrolling and scanning the frequency bandpass designed for and occupied by a communication hopping channels with a purpose to detect and select an available free communication hopping channel in order to provide a bi-directional data transfer and interchange with a remote RF communication system, and further detecting and selecting of an available communication hopping channels, and assigning and confirming of an available distinct first and a distinct second communication hopping channel with a purpose to establish a personal communication hopping channels and consequently to prevent the hop to the same carrier frequency for two smartcards at the same time, and synthesizing and generating of the assigned to communicate a personal first communication hopping channel and a personal second communication hopping channel for corresponding transfer and interchange of second and a response data signals, and furthermore providing a synchronization of a hope transitions of second communication hopping channels by means of control codes being a component of second data signal when first data signal is not available.

6. Two-way radio frequency (RF) data exchange system comprising remote RF communication terminal and a noncontact smartcard operable to communicate with said terminal within interrogate area, the system comprising:

transmitting and receiving means with first antenna module relating to a remote RF communication terminal designed for radiation of an energy-transmitting signal at first predetermined frequency which is being modulated by first data signal, and wherein said transmitting and receiving means with first antenna module additionally designed for generating and transmitting of a first communication hopping channels for transfer and interchange of second data signal, and for receiving of second communication hopping channels containing a response data signal from said noncontact smartcard, and which first and second communication hopping channels are predestined and designed to prevent collisions, interference and data interception of respectively second and response data signals while simultaneous operation of numerous smartcards when last are disposed at interrogate area in the same time, and wherein both first and second communication hopping channels disposed at a frequency bandpass located apart from first predetermined frequency, and wherein both first and second communication hopping channels occupying the same frequency bandpass, and wherein said transmitting and receiving means synthesizing a sequence of first and second communication hopping channels at a carrier hopping frequencies which are synchronized by first predetermined frequency as a reference, and wherein first communication hopping channels are combining respectively a plurality of downlink channels for transmission of a second data signal from a remote RF communication terminal to a noncontact smartcard while simultaneous operation of numerous noncontact smartcards when last are disposed at interrogate area in the same time, and wherein second communication hopping channels are combining respectively a plurality of uplink channels for transmission of a response data signal from a noncontact smartcard to a remote RF communication terminal while simultaneous operation of numerous noncontact smartcards when last are disposed at interrogate area in the same time, and wherein the plurality of downlink and uplink channels designed to operate in synchronized mode to prevent the hop to the same carrier frequency for two smartcards at the same time, and wherein both second data signal and a response data signal containing an encrypted specific identification information, and respectively an encrypted electronic value transfer, and wherein first data signal containing a control codes designed to synchronize a hope transitions of a separate carrier frequencies within said communication hopping channels in order to prevent collisions, interference and data interception, and moreover:

wherein said noncontact smartcard comprising second antenna module, microprocessor with memory, a reset circuit, a rectifier circuit and first clock conditioner, additionally comprising first and second multipliers, first modulation means and first demodulation means, first frequency synthesizer, and first transceiver connected to second antenna module performing a parallel resonance mode occurring at first predetermined frequency and exhibiting a series resonance mode occurring at a frequency bandpass occupied by first and second communication hopping channels, and, wherein a noncontact smartcard designed to:

receive an energy-transmitting signal at first predetermined frequency corresponding to a parallel resonance mode of second antenna module, and then predestined to:

receive second data signal and respectively transmit the response data signal using a series resonance mode of second antenna module at a frequency bandpass relating to first and second communication hopping channels, and wherein first frequency synthesizer is predetermined to produce a sequence of separate hopping frequencies employing carriers for second communication hopping channels, which hopping frequencies are synchronized by first predetermined frequency as a reference, and furthermore wherein a hope transitions of said separate hopping frequencies are controlled and synchronized by said control codes being a component of first data signal, and which codes are detected by said smartcard from an energy-transmitting signal.

7. Two-way radio frequency (RF) data exchange system of claim 6, wherein second antenna module comprising:

first inductive coil performing a parallel resonant circuit at first predetermined frequency for receiving an energy-transmitting signal from a remote RF communication terminal and for deriving a maximum of an induced electric energy to power the smartcard, and second inductive coil performing a series resonant circuit at a frequency bandpass predetermined for a plurality of downlink and uplink channels for receiving of second data signal and respectively for transmitting of a response data signal, and wherein a series resonant circuit performing transmitting/receiving antenna predetermined and designed to increase the power of a radiated response data signal transmitted via uplink channel back to remote RF communication terminal and therefore to increase a space and operating distance of the communication hopping channels, and wherein said frequency bandpass is significantly higher than first predetermined frequency of an energy-transmitting signal in order to prevent intermodulation distortion and interference between an energy-transmitting signal and a communication hopping channels, and:

wherein said frequency bandpass selected and designed to be significantly higher than first predetermined frequency with a purpose to provide a necessary width of a passband for allocation of a numerous hopping communication channels, and additionally wherein an equivalent admittance of second inductive coil, occurring at a frequency bandpass predetermined for the communication hopping channels, is significantly large than equivalent admittance of first inductive coil with a purpose to prevent electrical and electromagnetic mutual coupling, and, consequently, to eliminate mutual distortions, interference and intermodulation caused by an energy-transmitting signal, and wherein said parallel resonant circuit comprising a capacitor in parallel alignment with a first inductive coil with a purpose to achieve a parallel resonant mode, and:

wherein said series resonant circuit comprising second inductive coil in serial connection with a parallel alignment of said capacitor and first coil, and wherein first and second inductive coils manufactured as continuous flat winding, and wherein an equivalent impedance of first inductive coil, occurring at first predetermined frequency, is significantly large than equivalent impedance of second inductive coil with a purpose to prevent electrical and electromagnetic mutual coupling, and, consequently, to eliminate mutual distortions, interference and intermodulation caused by an energy-transmitting signal.

8. Two-way radio frequency (RF) data exchange system claim 6, wherein second antenna module containing first inductive coil performing a parallel resonant circuit at first predetermined frequency for receiving an energy-transmitting signal from a remote RF communication terminal and then for subsequent deriving of maximum of an induced electric energy to power the smartcard, additionally comprising a conductive strip performing a microwave antenna, and wherein the conductive strip combining an equivalent series resonant circuit with a distributed capacitance between said conductive strip and turns of a said inductive coil, and wherein said series resonant circuit performing an antenna for respectively receiving and transmitting of second data signal and of a response data signal at a microwave frequency bandpass predetermined for a plurality of downlink and uplink channels which are located apart from first predetermined frequency, and wherein a series resonant circuit performing transmitting/receiving antenna predetermined and designed to increase the power of a radiated response data signal transmitted via uplink channel back to remote RF communication terminal and, therefore, to increase a space and operating distance of the communication hopping channels, and moreover:

wherein said microwave frequency bandpass is significantly higher than first predetermined frequency of an energy-transmitting signal in order to provide electrical separation and prevent electromagnetic mutual coupling, and, therefore, to eliminate mutual and intermodulation distortion, interference and collisions between an energy-transmitting signal and a communication hopping channels, and wherein said frequency bandpass selected and designed to be significantly higher than first predetermined frequency with a purpose to provide a necessary width of a passband for allocation of a numerous hopping communication channels, and additionally wherein an equivalent impedance of said series alignment of conductive strip with said distributed capacitance occurring at first predetermined frequency, is significantly large to load an equivalent impedance of first inductive coil with a purpose to provide electrical separation and prevent electromagnetic mutual coupling, and, therefore, to eliminate mutual distortions, interference and intermodulation caused by an energy-transmitted signal, and wherein an equivalent admittance of said series alignment of conductive strip with said distributed capacitance, occurring at a frequency bandpass predetermined for a communication hopping channels, is significantly large than equivalent admittance of first coil with a purpose to provide electrical separation and prevent electromagnetic mutual coupling and therefore to eliminate mutual distortions, interference and intermodulation caused by an energy-transmitted signal.

9. Two-way radio frequency (RF) data exchange system of claim 7 comprising a noncontact smartcard wherein:

said microprocessor designed to process second data signal received over downlink channel from a remote RF communication terminal, and consequently to produce a response data signal to be transmitted over uplink channel back to a remote RF communication terminal, and additionally wherein said microprocessor designed to select, desire, confirm and assign one of an available communication hopping channels to perform a personal downlink/uplink channel with a purpose to prevent the hop to the same frequency of two noncontact smartcards at the same time, and in addition:

wherein said microprocessor designed to manage and manipulate with operations of synchronization and switching of hope transitions of an assigned carrier frequency for second communication hopping channels with a purpose to prevent the hop to the same frequency of two noncontact smartcards at the same time, and furthermore:

wherein first frequency synthesizer producing first and second subcarrier frequencies to be used as a reference for frequency conversion respectively in first and second multipliers, and wherein first multiplier intended to produce a shift-down of a received carrier frequency of an assigned personal downlink channel by means of utilizing the first subcarrier frequency as reference and wherein first demodulation means designed to provide detecting of a shifted-down received carrier frequency with further extracting of second data signal to be input into a microprocessor, and wherein first modulation means are designed to transform a response data signal produced by microprocessor to a form suitable for transmission over a communication hopping channel, and wherein second multiplier is determined and designed to shift-up an output signal of first modulation means with a purpose to obtain a modulated assigned carrier hopping frequency for transmission within an assigned personal uplink channel, and wherein second multiplier utilizing second subcarrier frequency as a reference for producing a frequency shift-up till an assigned carrier hopping frequency for transmission within an assigned personal uplink channel, and wherein first transceiver is designed to receive and amplify second data signal transmitted by remote RF communication terminal over downlink channel, and, consequently, to amplify and transmit a response data signal over uplink channel.

10. Two-way radio frequency (RF) data exchange system of claim 9, wherein input of first clock conditioner is connected to first coil of second antenna module performing a parallel resonant circuit, and wherein first clock conditioner predetermined to produce a shaped clock signal to run said microprocessor, and wherein first clock conditioner designed to select and recover first predetermined frequency in order to provide a reference signal for first frequency synthesizer with a purpose to synchronize the synthesized carrier hopping frequencies, and:

wherein first frequency synthesizer controlled and manipulated by microprocessor with a target to provide a sequential switching of first and second subcarrier frequencies in correspondence to a desired sequence of an assigned carrier hopping frequencies.

11. Two-way radio frequency (PF) data exchange system of claim 10, wherein first frequency synthesizer comprising:

first programmable divider designed to produce a frequency reference signal predetermined to establish and obtain a frequency slot for an assigned carrier hopping frequency relating to an assigned personal communication hopping channel, and wherein a recovered first predetermined frequency employs an input clock signal for first programmable divider, an d additionally, said recovered first pre determined frequency performs phase synchronization of said assigned carrier hopping frequency, and, additionally, first frequency synthesizer comprising:

second programmable divider designed to obtain a feedback reference frequency in order to synthesize and acquire a subcarrier hopping frequency in correspondence to said assigned carrier hopping frequency relating to the assigned personal communication hopping channel, and, furthermore, first frequency synthesizer comprising:

a voltage controlled oscillator (VCO) designed to generate first and second subcarrier hopping frequencies, and wherein VCO performs a local oscillator (LO) function for a production of a frequency shift-down and a frequency shift-up in first and second multipliers respectively, and wherein first subcarrier hopping frequency is intended to employ a LO frequency for first multiplier to produce a shift-down of said received carrier hopping frequency of corresponding assigned personal downlink channel, and wherein second subcarrier hopping frequency is intended to employ a LO frequency for second multiplier to produce a shift-up till an assigned for transmission a carrier hopping frequency of corresponding assigned personal uplink channel, and, further, first frequency synthesizer containing:

a channel programmable memory (PROM) designed to set directly a divide ratio for first and second programmable dividers with a purpose to reduce the ripples of VCO by means of decreasing a switch and settle time of both first and second programmable dividers, and wherein a channel PROM controlled by said microprocessor, and, additionally, first frequency synthesizer including, a phase detector connected in series with a loop low pass filter and designed to compare a frequency reference signal, produced by first programmable divider, with said feedback reference frequency for obtaining a phase difference signal and hence to control and regulate the VCO's oscillation providing maintenance of first and second subcarrier hopping frequencies to be disposed in said assigned frequency slot, and, accordingly, to be proportional to an assigned carrier hopping frequency in correspondence to the desired and assigned personal downlink/uplink channels.

12. Two-way radio frequency (RF) data exchange system of claim 11 wherein a remote RF communication terminal containing controller, power transmitter, first antenna module, and an additional RF circuitry predestined for transmitting/receiving over said downlink/uplink channels and comprising second transceiver, third and forth multipliers, second modulator means and second demodulator means, second and third frequency synthesizers and a reference oscillator, and wherein, additionally, first antenna module comprising:

a low frequency (LF) antenna designed for radiation of an energy-transmitting signal at first predetermined frequency, and additionally comprising a high frequency (HF) antenna for transmitting and receiving respectively over downlink and uplink channels, and wherein a power transmitter coupled with the LF antenna for radiation of an energy-transmitting signal to power a noncontact smartcard, and wherein second transceiver coupled with the HF antenna, and predetermined to transmit second data signal over downlink channels and receive a response data signal over uplink channels, and wherein third multiplier determined to shift-down a received carrier frequency of an uplink channel, and wherein second demodulation means predestined for detecting a shifted-down received uplink channel with subsequent extracting a response data signal to be input to said controller, and wherein second modulation means predestined to transform second data signal produced by said controller to a form suitable for a transmission over a communication hopping channel, and wherein forth multiplier determined and designed to shift-up an output signal of second modulation means in order to obtain a modulated carrier frequency of a desired and assigned communication hopping channel for transmission over downlink channel, and wherein second frequency synthesizer predestined and designed for generating a sequence of subcarrier frequencies corresponding to first and second communication hopping channels, and wherein third frequency synthesizer predestined and designed to produce first predetermined frequency corresponding to a parallel resonance mode of second antenna module to power a noncontact smartcard, and wherein a reference oscillator predestined to synchronize both second and third frequency synthesizers, and wherein said controller designed to manage and manipulate with second frequency synthesizer, third frequency synthesizer, second modulation means, and second demodulation means, and wherein said controller is designed to manipulate with procedures of synchronization and switching of a sequence of downlink and uplink hopping channels, and to maintain a synthesized frequency of an energy transmitting electromagnetic signal which is predestined to power a noncontact smartcard, and wherein said controller generating said control codes designed to synchronize a hope transitions of carrier frequency of a sequence of said downlink and uplink hopping channels, and wherein said controller is intended to manage and maintain the operations of encryption, identification, toll collection, payment, and an electronic value transfer.

13. Two-way radio frequency (RF) data exchange system of claim 12, designed to provide vehicle identification and toll collection, and additionally comprising an in-vehicle unit arranged within a vehicle with a purpose to increase an interrogation area, and wherein a remote RF communication terminal is arranged at a roadside toll collection area with a purpose to provide a vehicle identification and maintain a toll collection and an electronic fund transfer, and wherein said noncontact smartcard arranged inside a vehicle proximate to said in-vehicle unit, and wherein said noncontact smartcard operable to communicate with both said terminal and with an in-vehicle unit, which is predestined and designed for:

receiving first predetermined frequency corresponding to energy-transmitting signal radiated by remote RF communication terminal and then for:

verifying the field strength of said energy-transmitting signal at a smartcard location area with a purpose to check whether the field strength is enough to induce an electric energy which is adequate to power the smartcard, and furthermore for performing regeneration with following re-radiation of an extra portion of energy-transmitting alternating field if the field strength at first predetermined frequency is not adequate to power the smartcard when vehicles are passing far away of a remote RF communication terminal at a distance range disallowing to induce directly an electric energy sufficient to power the smartcard, and wherein the regenerated and re-radiated extra portion of an energy-transmitting alternating field is synthesized and synchronized in correspondence with received first predetermined frequency being a reference, and wherein the frequency of a regenerated and retransmitted synthesized energy-transmitting alternating field is designed to be equal to a frequency of a parallel resonance mode of second RF antenna in order to maximize the derived voltage to power the smartcard.

14. Two-way radio frequency (RF) data exchange system of claim 13, wherein an in-vehicle unit having microcontroller, third antenna module, and additionally comprising a retransceiver, forth frequency synthesizer, a voltage comparator and second clock conditioner, and:

wherein third antenna module coupled with retransceiver and both designed for receiving a signal at first predetermined frequency and retransmitting of an extra portion of energy-transmitting alternating field at second predetermined frequency, and wherein forth frequency synthesizer producing a second predetermined frequency which is designed to be equal to a frequency of a parallel resonance mode of second antenna module arranged at said noncontact smartcard, and wherein a voltage comparator predetermined to compare and verify the amplitude of first predetermined frequency with a reference voltage level corresponding to the field strength which is adequate to power said noncontact smartcard, and thereafter a voltage comparator intended to produce an enable signal allowing operation of forth frequency synthesizer if the field strength is not enough to induce an electric energy which is adequate to power the smartcard, and wherein second clock conditioner recovering the first predetermined frequency from an energy-transmitting signal in order to provide a reference clock signal for forth synthesizer with a purpose to achieve of a phase and frequency correction of an extra portion of an energy-transmitting alternating field, and wherein microcontroller is designed to manipulate with tuning of second predetermined frequency to be equal to a frequency of a parallel resonance mode of second antenna module when a different types of noncontact smartcards are used.

15. Two-way radio frequency (RF) data exchange system of claim 8 comprising a noncontact smartcard wherein:

said microprocessor designed to process second data signal received over downlink channel from a remote RF communication terminal, and consequently to produce a response data signal to be transmitted over uplink channel to a remote RF communication terminal, and additionally wherein said microprocessor designed to select, desire, confirm and assign one of an available communication hopping channels to perform a personal downlink/uplink channel with a purpose to prevent the hop to the same frequency of two noncontact smartcards at the same time, and in addition:

wherein said microprocessor designed to manage and manipulate with operations of synchronization and switching of hope transitions of an assigned carrier frequency for second communication hopping channels with a purpose to prevent the hop to the same frequency of two noncontact smartcards at the same time, and furthermore:

wherein first frequency synthesizer producing first and second subcarrier frequencies to be used as a reference for frequency conversion respectively in first and second multipliers, and wherein first multiplier intended to produce a shift-down of a received carrier frequency of an assigned personal downlink channel by means of utilizing the first subcarrier frequency as reference, and wherein first demodulation means designed to provide detecting of a shifted-down received carrier frequency with further extracting of second data signal to be input into a microprocessor, and wherein first modulation means are designed to transform a response data signal produced by microprocessor to a form suitable for transmission over a communication hopping channel, and wherein second multiplier is determined and designed to shift-up an output signal of first modulation means with a purpose to obtain a modulated assigned carrier hopping frequency for transmission within an assigned personal uplink channel, and wherein second multiplier utilizing second subcarrier frequency as a reference for producing a frequency shift-up till an assigned carrier hopping frequency for transmission within an assigned personal uplink channel, and wherein first transceiver is designed to receive and amplify second data signal transmitted by remote RF communication terminal over downlink channel, and, consequently, to amplify and transmit a response data signal over uplink channel.

16. Two-way radio frequency (RF) data exchange system of claim 15, wherein input of first clock conditioner is connected to first coil of second antenna module performing a parallel resonant circuit, and wherein first clock conditioner predetermined to produce a shaped clock signal to run said microprocessor, and wherein first clock conditioner designed to select and recover first predetermined frequency in order to provide a reference signal for first frequency synthesizer with a purpose to synchronize the synthesized carrier hopping frequencies, and:

wherein first frequency synthesizer controlled and manipulated by microprocessor with a target to provide a sequential switching of first and second subcarrier frequencies in correspondence to a desired sequence of an assigned carrier hopping frequencies.

17. Two-way radio frequency (RF) data exchange system of claim 16, wherein first frequency synthesizer comprising:

first programmable divider designed to produce a frequency reference signal predetermined to establish and obtain a frequency slot for an assigned carrier hopping frequency relating to an assigned personal communication hopping channel, and wherein a recovered first predetermined frequency employs an input clock signal for first programmable divider, and additionally, said recovered first predetermined frequency performs phase synchronization of said assigned carrier hopping frequency, and, additionally, first frequency synthesizer comprising:

second programmable divider designed to obtain a feedback reference frequency in order to synthesize and acquire a subcarrier hopping frequency in correspondence to said assigned carrier hopping frequency relating to the assigned personal communication hopping channel, and, furthermore, comprising:

a voltage controlled oscillator (VCO) designed to generate first and second subcarrier hopping frequencies, and wherein VCO performs a local oscillator (LO) function for a production of a frequency shift-down and a frequency shift-up in first and second multipliers respectively, and wherein first subcarrier hopping frequency is intended to employ a LO frequency for first multiplier to produce a shift-down of said received carrier hopping frequency of corresponding assigned personal downlink channel, and wherein second subcarrier hopping frequency is intended to employ a LO frequency for second multiplier to produce a shift-up till an assigned for transmission a carrier hopping frequency of corresponding assigned personal uplink channel, and, further, first frequency synthesizer containing a channel programmable memory (PROM) designed to set directly a divide ratio for first and second programmable dividers with a purpose to reduce the ripples of VCO by means of decreasing a switch and settle time of both first and second programmable dividers, and wherein a channel PROM controlled by said microprocessor, and additionally including a phase detector connected in series with a loop low pass filter and designed to compare a frequency reference signal, produced by first programmable divider, with said feedback reference frequency for obtaining a phase difference signal and hence to control and regulate the VCO's oscillation providing maintenance of first and second subcarrier hopping frequencies to be disposed in said assigned frequency slot, and, accordingly, to be proportional to an assigned carrier hopping frequency in correspondence to the desired and assigned personal downlink/uplink channels.

* * * * *